US012465111B2

(12) United States Patent
Dubois et al.

(10) Patent No.: US 12,465,111 B2
(45) Date of Patent: Nov. 11, 2025

(54) SKATE OR OTHER FOOTWEAR

(71) Applicant: BAUER HOCKEY LLC, Exeter, NH (US)

(72) Inventors: Sebastien Dubois, Piedmont (CA); Christopher Francis, Pierrefonds-Roxboro (CA); Robert Lavoie, St-Jerome (CA); Sebastien Lambert, St-Jerome (CA); Peter Liu, Taichung (TW)

(73) Assignee: BAUER HOCKEY LLC, Exeter, NH (US)

( * ) Notice: Subject to any disclaimer, the term of this patent is extended or adjusted under 35 U.S.C. 154(b) by 176 days.

(21) Appl. No.: 16/996,836

(22) Filed: Aug. 18, 2020

(65) Prior Publication Data

US 2021/0251332 A1 Aug. 19, 2021

Related U.S. Application Data

(60) Provisional application No. 62/976,392, filed on Feb. 14, 2020.

(51) Int. Cl.
*A43B 5/16* (2006.01)
*A43B 23/04* (2006.01)
(Continued)

(52) U.S. Cl.
CPC ..... *A43B 5/1641* (2013.01); *A43B 5/1616* (2013.01); *A43B 5/1625* (2013.01); *A43B 5/1683* (2013.01); *A43B 5/1691* (2013.01); *A43B 23/086* (2013.01); *A63C 1/00* (2013.01); *A63C 1/42* (2013.01)

(58) Field of Classification Search
CPC ... A43B 5/1641; A43B 5/1616; A43B 5/1625; A43B 5/1683; A43B 5/1691; A63C 1/00
See application file for complete search history.

(56) References Cited

U.S. PATENT DOCUMENTS 5,437,466 A * 8/1995 Meibock ..... A43B 7/28 280/11.3
5,794,362 A * 8/1998 Polk, III ..... A43B 5/0427 36/97

(Continued)

FOREIGN PATENT DOCUMENTS

EP 1013315 A1 * 6/2000 ..... A43B 17/00
WO 2019057943 3/2019

OTHER PUBLICATIONS

Examiner's Report issued on Dec. 15, 2023 in connection with Canadian Patent application No. 3090351, 7 pages.

(Continued)

*Primary Examiner* — Khoa D Huynh
*Assistant Examiner* — Erick I Lopez

(57) ABSTRACT

Footwear, such as a skate (e.g., a hockey skate), comprising a boot (e.g., a skate boot) or other foot-receiving structure configured to receive a user's foot, in which the boot or other foot-receiving structure is designed to enhance performance, including a range of motion of the user and energy transfer (e.g., to a skating surface while skating or otherwise moving on the skating surface), fit on the user's foot, and/or comfort of the user, such as by having articulated, thermoformable and/or removable parts that may have desired properties in selected regions.

43 Claims, 26 Drawing Sheets

(51) Int. Cl.

| | |
|---|---|
| ***A43B 23/08*** | (2006.01) |
| ***A63C 1/00*** | (2006.01) |
| ***A63C 1/42*** | (2006.01) |

(56) References Cited

U.S. PATENT DOCUMENTS

| | | | | |
|---|---|---|---|---|
| 5,894,680 | A * | 4/1999 | Dalvy | A47L 23/205 34/442 |
| 6,295,679 | B1 * | 10/2001 | Chenevert | A43B 5/1666 280/11.221 |
| 6,340,164 | B1 * | 1/2002 | Borel | A43B 5/1641 280/11.224 |
| 6,371,494 | B1 | 4/2002 | Bonaventure et al. | |
| 7,152,865 | B2 * | 12/2006 | Chen | A43B 5/1608 280/11.26 |
| 7,219,900 | B2 * | 5/2007 | Meibock | A43B 5/0427 280/11.12 |
| 2002/0041073 | A1 * | 4/2002 | Chen | A63C 1/26 280/11.26 |
| 2003/0102641 | A1 * | 6/2003 | Liu | A63C 17/06 280/11.224 |
| 2005/0116379 | A1 * | 6/2005 | Goldsmith | B29C 70/345 264/222 |
| 2011/0083343 | A1 * | 4/2011 | Holzer | A43B 5/0433 36/117.1 |
| 2011/0101665 | A1 * | 5/2011 | Van Horne | A43B 5/1691 280/841 |
| 2014/0250733 | A1 * | 9/2014 | Cruikshank | A43B 5/1666 36/115 |
| 2017/0042280 | A1 * | 2/2017 | Bacino | A41B 11/005 |
| 2017/0080323 | A1 * | 3/2017 | Dubois | A43B 5/1683 |
| 2017/0280819 | A1 * | 10/2017 | Corbeil | B32B 29/08 |

OTHER PUBLICATIONS

Examiner's Report issued on Dec. 17, 2024 in connection with Canadian Patent application No. 3090351, 5 pages.

* cited by examiner

SKATE OR OTHER FOOTWEAR

CROSS-REFERENCE TO RELATED APPLICATION

This application claims the benefit of U.S. Provisional Patent Application Ser. No. 62/976,392, filed on Feb. 14, 2020. The contents of the aforementioned application are incorporated by reference herein.

FIELD

The disclosure generally relates to footwear, such as skates for playing hockey or other skating activities, or other types of footwear.

BACKGROUND

Skates are used by users in various sports such as ice hockey or roller hockey and other activities. A skate comprises a skate boot that typically comprises a number of parts assembled together to form the skate boot. This can include a body, sometimes referred to as a "shell", a toe cap, a tongue, a tendon guard, etc.

While existing skates may offer decent performances, they may have some drawbacks. For instance, characteristics of those skates (e.g., range of motion of a user's foot, power transfer between the user's foot and a skating surface, comfort, customability, etc.) may be incompatible with one another and therefore some may need to be sacrificed during design of those skates.

Similar considerations may sometimes arise for other types of footwear (e.g., ski boots, snowboarding boots, etc.).

For these and/or other reasons, there is a need to improve skates and/or other footwear.

SUMMARY

In accordance with various aspects, this disclosure relates to footwear, such as a skate (e.g., a hockey skate), comprising a boot (e.g., a skate boot) or other foot-receiving structure configured to receive a user's foot, in which the boot or other foot-receiving structure is designed to enhance performance, including a range of motion of the user and energy transfer (e.g., to a skating surface while skating or otherwise moving on the skating surface), fit on the user's foot, and/or comfort of the user, such as by having articulated, thermoformable and/or removable parts that may have desired properties in selected regions.

For example, in accordance with an aspect of the disclosure, there is provided a skate boot for a skate. The skate boot defines a cavity to receive a user's foot. The skate boot comprises a shell comprising a medial side portion configured to face a medial side of the user's foot, a lateral side portion configured to face a lateral side of the user's foot, a heel portion configured to face a heel of the user's foot, and an ankle portion configured to face an ankle of the user. The shell is articulated such that at least part of the ankle portion of the shell is movable relative to at least part of the medial side portion of the shell, at least part of the lateral side portion of the shell, and at least part of the heel portion of the shell. The skate boot comprises a liner removably disposed within the shell and thermoformable about the user's foot.

In accordance with another aspect of the disclosure, there is provided a skate boot for a skate. The skate boot defines a cavity to receive a user's foot. The skate boot comprises a shell comprising a medial side portion configured to face a medial side of the user's foot, a lateral side portion configured to face a lateral side of the user's foot, a heel portion configured to face a heel of the user's foot, and an ankle portion configured to face an ankle of the user. The shell comprises a lower shell member including at least part of the medial side portion of the shell, at least part of the lateral side portion of the shell, and at least part of the heel portion of the shell. The shell comprises an upper shell member including at least part of the ankle portion of the shell and pivotable relative to the lower shell member. The skate boot comprises a liner removably disposed within the shell and thermoformable about the user's foot.

In accordance with another aspect of the disclosure, there is provided a skate boot for a skate. The skate boot defines a cavity to receive a user's foot. The skate boot comprises a shell comprising a medial side portion configured to face a medial side of the user's foot, a lateral side portion configured to face a lateral side of the user's foot, a heel portion configured to face a heel of the user's foot, and an ankle portion configured to face an ankle of the user. The shell is articulated such that at least part of the ankle portion of the shell is movable relative to at least part of the medial side portion of the shell, at least part of the lateral side portion of the shell, and at least part of the heel portion of the shell. The shell is thermoformable about the user's foot. The skate boot comprises a liner disposed within the shell.

In accordance with another aspect of the disclosure, there is provided a skate boot for a skate. The skate boot defines a cavity to receive a user's foot. The skate boot comprises a shell comprising a medial side portion configured to face a medial side of the user's foot, a lateral side portion configured to face a lateral side of the user's foot, a heel portion configured to face a heel of the user's foot, and an ankle portion configured to face an ankle of the user. The shell is articulated such that at least part of the ankle portion of the shell is movable relative to at least part of the medial side portion of the shell, at least part of the lateral side portion of the shell, and at least part of the heel portion of the shell. The shell includes a plurality of zones that differ in stiffness. The skate boot comprises a liner disposed within the shell.

In accordance with another aspect of the disclosure, there is provided a skate boot for a skate. The skate boot defines a cavity to receive a user's foot. The skate boot comprises a shell comprising a medial side portion configured to face a medial side of the user's foot, a lateral side portion configured to face a lateral side of the user's foot, a heel portion configured to face a heel of the user's foot, and an ankle portion configured to face an ankle of the user. The skate boot comprises a liner removably disposed within the shell, thermoformable about the user's foot, and including a plurality of thermoformable materials that are different.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice; and a blade holder between the skate boot and the blade. The shell comprises a plurality of pieces that are movable relative to one another. The liner is removably disposed within the shell and thermoformable about the user's foot.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice; and a blade holder between the skate boot and the blade. The shell comprises a first piece and a second piece, the first piece being moveably connected to the second piece. The liner is removably disposed within the shell and thermoformable about the user's foot.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice; and a blade holder between the skate boot and the blade. The shell comprises a first piece and a second piece, the first piece being pivotably connected to the second piece. The liner is removably disposed within the shell and thermoformable about the user's foot.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice; and a blade holder between the skate boot and the blade. The skate boot comprises an upper portion and a lower portion; and the goalie skate is configured to allow movement of a lower leg of the wearer relative to the lower portion of the skate boot when the hockey goalkeeper wears the goalie skate and while the lower leg of the wearer does not move relative to the upper portion of the skate boot. The liner is removably disposed within the shell and thermoformable about the user's foot.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice; and a blade holder between the skate boot and the blade. The skate boot comprises an upper portion. The goalie skate is configured to allow movement of a lower leg of the wearer relative to the blade when the hockey goalkeeper wears the goalie skate and while the lower leg of the wearer does not move relative to the upper portion of the skate boot. The liner is removably disposed within the shell and thermoformable about the user's foot.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice; and a blade holder between the skate boot and the blade. The skate boot comprises an upper portion. The goalie skate is configured to allow movement of a lower leg of the wearer relative to the blade holder when the hockey goalkeeper wears the goalie skate and while the lower leg of the wearer does not move relative to the upper portion of the skate boot. The liner is removably disposed within the shell and thermoformable about the user's foot.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice and a blade holder between the skate boot and the blade. The shell and the liner are thermoformable such that: the shell can be heated to a first pre-determined temperature at which an original shape of the shell can be altered into an altered shape of the shell and the shell can keep altered shape of the shell after cooling down; and the liner can be heated to a second pre-determined temperature at which an original shape of the liner can be altered into an altered shape of the liner and the liner can keep altered shape of the liner after cooling down.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice, and a blade holder between the skate boot and the blade. The liner is removable from the skate boot and is thermoformable such that the liner can be heated to a pre-determined temperature at which an original shape of the liner can be altered into an altered shape of the liner and the liner can keep altered shape of the liner after cooling down.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice, and a blade holder between the skate boot and the blade. The liner comprises a first zone comprising a first material having a first rigidity and a second zone comprising a second material rigidity, the first rigidity being greater than the second rigidity, a ratio of the first rigidity over the second rigidity being at least 2.

In accordance with another aspect of the disclosure, there is provided a goalie skate for a hockey goalkeeper. The goalie skate comprises a skate boot for receiving a foot of the hockey goalkeeper, the skate boot comprising a shell and a liner, a blade for contacting ice, and a blade holder between the skate boot and the blade. The shell comprises a portion where an internal surface of the shell can be punched to plastically deform the shell to enlarge a cavity of the skate boot.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice, and a blade holder between the skate boot and the blade. The shell comprises a portion where an external surface of the shell is smooth and has a lower friction coefficient with ice than a lateral portion of a skate boot.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice, and a blade holder between the skate boot and the blade. The shell comprises a plurality of ribs, the ribs comprising a torsional rib contributing to a torsional stiffness of the skate boot, the ribs comprising an impact rib configured to dissipate energy of an impact with a flying puck when the impact occurs on the impact rib.

In accordance with another aspect of the disclosure, there is provided a goalie skate for a hockey goalkeeper. The goalie skate comprises a skate boot for receiving a foot of the hockey goalkeeper, the skate boot comprising a shell and a liner. The goalie skate comprises a blade for contacting ice, and a blade holder between the skate boot and the blade. The shell comprises a plurality of ribs, the ribs comprising a torsional rib contributing to a torsional stiffness of the skate boot, the ribs comprising an impact rib configured to spread energy of an impact with a flying puck when the impact occurs on the impact rib.

These and other aspects of this disclosure will now become apparent to those of ordinary skill in the art upon review of the following description of embodiments in conjunction with the accompanying drawings.

BRIEF DESCRIPTION OF DRAWINGS

A detailed description of embodiments of the disclosure is provided below, by way of example only, with reference to drawings annexed hereto, in which.

Figure 1:
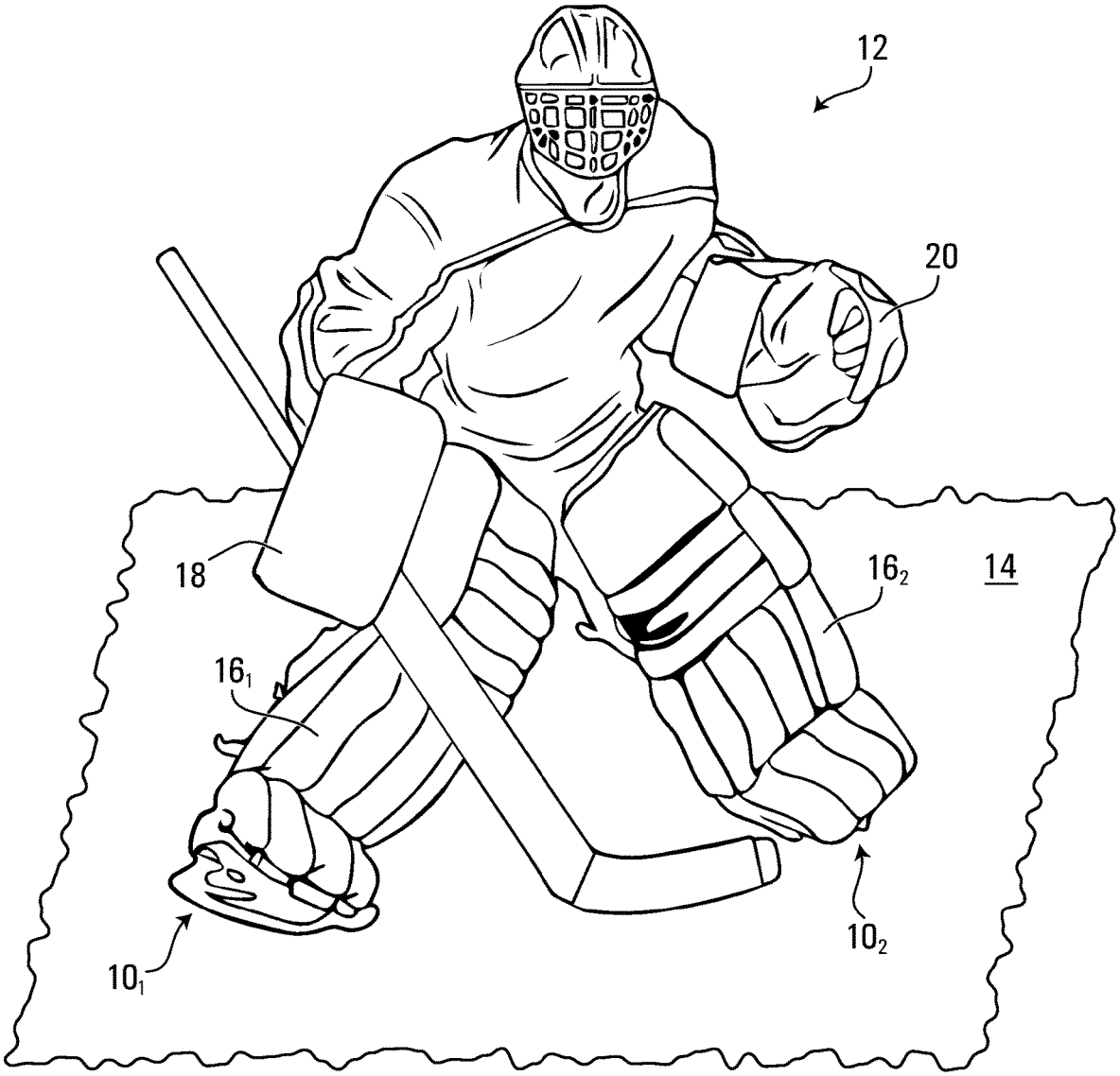
FIG. 1 is an example of a user wearing a skate in accordance with an embodiment, wherein the user is a hockey goalkeeper (i.e., goalie) and the skate is a goalie skate.
Figure 2:
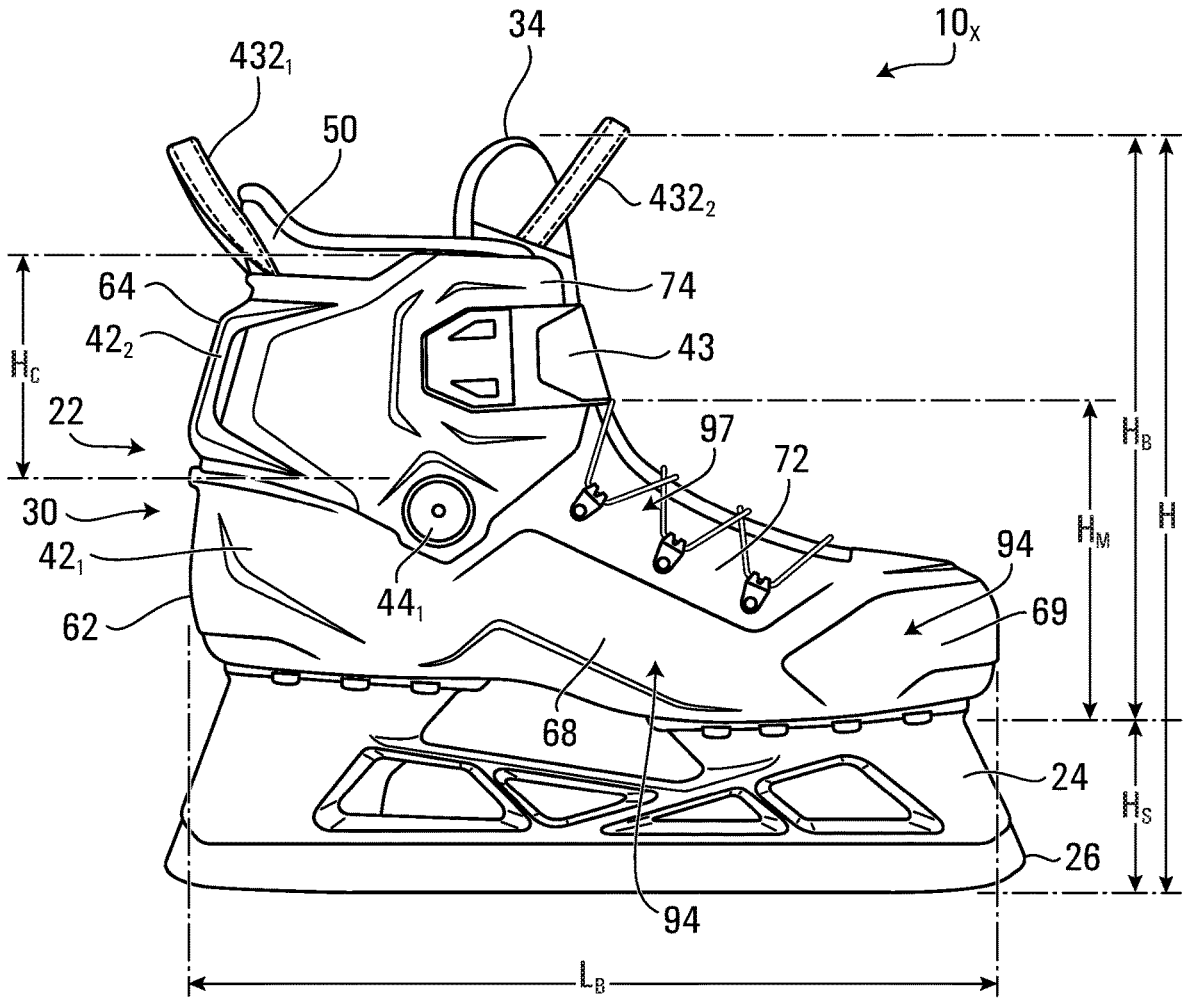
FIG. 2 shows a side view of the goalie skate including a skate boot, a blade holder and a blade, the skate boot comprising a shell and a liner, the shell comprising a main foot-covering shell element and a cuff.

In the drawings, embodiments are illustrated by way of example. It is to be expressly understood that the description and drawings are only for purposes of illustration and as an aid to understanding, and are not intended to be limiting.

DETAILED DESCRIPTION OF EMBODIMENTS

FIG. 1 shows an embodiment of a skate 10 for a user 12 to skate on a skating surface 14. In this embodiment, the skate 10 is a goalie skate for the user 12 who is a hockey goalie (i.e., goalkeeper) defending his/her team's goal in a game of hockey. In this example, a type of hockey played is ice hockey and the skating surface 14 is ice. The goalie 12 also wears other equipment for goalkeeping, including, in this embodiment, leg pads 161, 162 to protect his/her legs when used to stop a projectile, i.e., a puck or ball, during play and/or when moving (e.g., dropping) them onto the playing surface 14, as well as a blocker 18 and a catcher 20 to stop the puck or ball with his/her arms and hands.

The skate 10 comprises a skate boot 22 configured to receive a foot 11 of the goalie 12 and a skating device 28 disposed beneath the skate boot 22 to engage the ice 14. In this embodiment, the skating device 28 comprises a blade 26 for contacting the ice 14 and a blade holder 24 between the skate boot 22 and the blade 26. The skate 10 has a longitudinal direction, a widthwise direction, and a heightwise direction.

As further discussed later, in this embodiment, the skate boot 22 is designed to enhance performance, including a range of motion of the goalie 12 and energy transfer to the ice 14 while skating or otherwise moving on the ice 14, fit on the goalie's foot 11, and/or comfort of the goalie 12, such as by having articulated, thermoformable and/or removable parts that may have desired properties in selected regions.

In this embodiment, the skate 10 is designed specifically for goalkeeping by the goalie 12, as opposed to other skates for hockey players other than goalies (i.e., forwards and defensemen), and can thus be referred to as "goalie skates". Goalie skates may differ from other skates for hockey players other than goalies in many aspects, as those with ordinary skill in the art will appreciate. For example, goalie skates typically are free from a tendon guard and have a tongue which defines their highest point (i.e., the point that is farthest from an ice-contacting surface of the skate's runner), resulting in a ratio of a height of the skate boot over a length of the skate boot that is relatively small (e.g. no more than 0.8), which allows the skates to be lighter and allow the goalie to be more agile, while player skates often have a tendon guard that is configured to protect the Achille's tendon, which results in a higher ratio of a height of the skate boot over a length of the skate boot. As another example, goalie skates typically have a blade with a flat portion of an ice-contacting surface that is relatively high (e.g., at least 70% of a length of the blade) which allows goalies to also be more agile, while player skates often have a blade with no flat portion or with a flat portion of an ice-contacting surface that is smaller to increase power transfer during a skating stride. As another example, goalie skates typically have a cowling to protect the goalie's foot from impact with flying pucks and hold the blade of the goalie skate, or reinforced portions in the skate boot to protect the goalie's foot from impact with flying pucks and hold the blade of the goalie skate as described in U.S. patent application Ser. No. 15/270,756, which is incorporated by reference herein in its entirety, while player skates often do not comprise such cowling or reinforced portions to reduce their weight and/or improve their performances.

Figure 46:
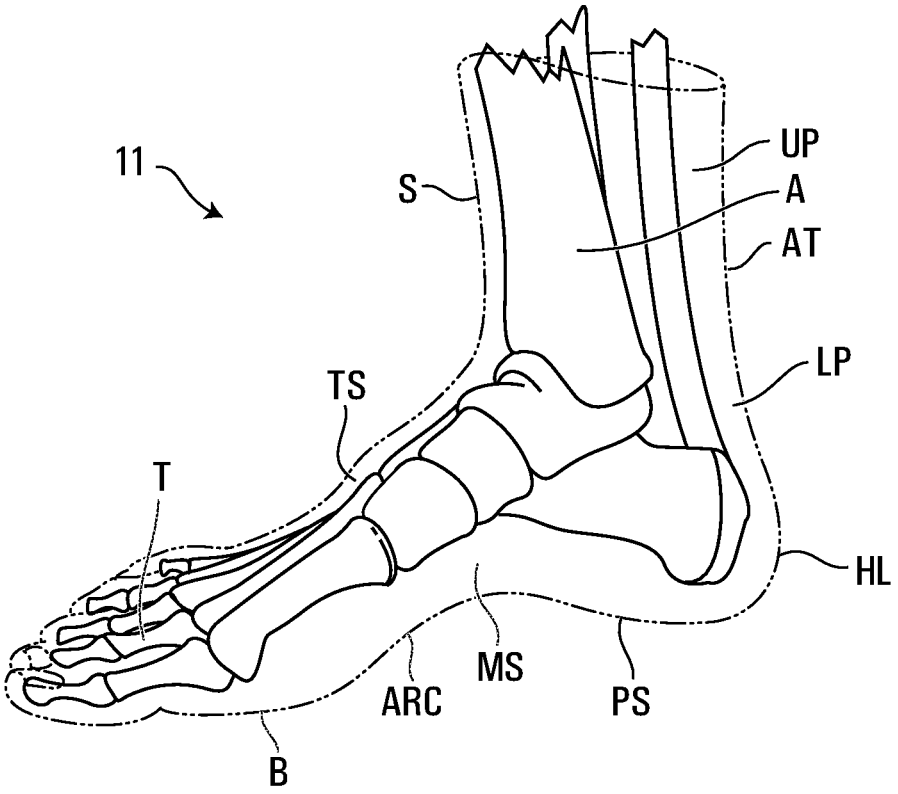
FIGS. 46 and 47 are side and front views of a right foot of the goalie with an integument of the foot shown in dotted lines and bones shown in solid lines.
Figure 47:
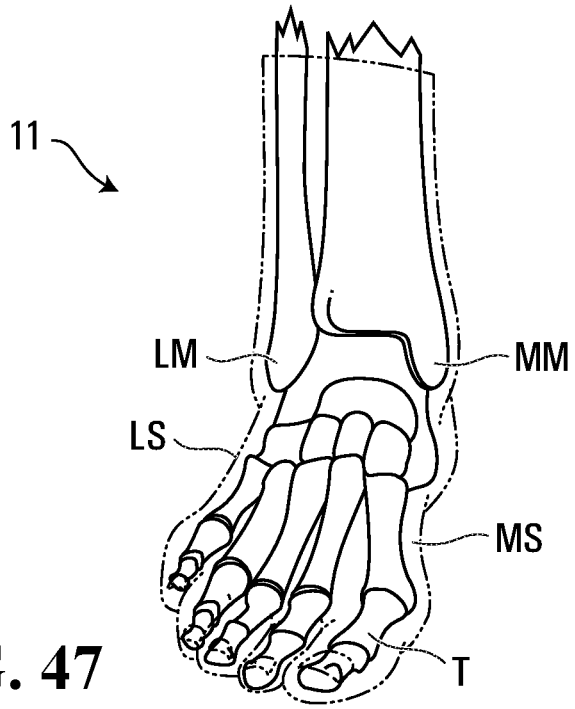

The skate boot 22 defines a cavity 54 for receiving the goalie's foot 11. With additional reference to FIGS. 46 and 47, the goalie's foot 11 includes toes T, a ball B, an arch ARC, a plantar surface PS, a top surface TS, a medial side MS, and a lateral side LS.

The top surface TS of the goalie's foot 11 is continuous with a lower portion of a shin S of the goalie 12. In addition, the goalie 12 has a heel HL, an Achilles tendon AT, and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel HL. A forefoot of the goalie 12 includes the toes T and the ball B, a hindfoot of the goalie includes the heel HL, and a midfoot of the goalie is between the forefoot and the hindfoot.

More particularly, the skate boot 22 may comprise a heel portion 21 configured to face the heel HL of the goalie's foot, an ankle portion 23 configured to face the ankle A of the goalie, a medial side portion 25 configured to face the medial side MS of the goalie's foot, a lateral side portion 27 configured to face the lateral side LS of the goalie's foot, an instep portion 41 configured to face the instep IN of the goalie's foot, a sole portion 29 configured to face the plantar surface PS of the goalie's foot, and a toe portion 19 configured to receive the toes T of the goalie's foot.

As it is for goalkeeping, the skate boot 22 may be shorter than skate boots of conventional skates for hockey players other than goalies. For example, in some embodiments, a ratio $H_B/L_B$ of a height $H_B$ of the skate boot 22 over a length $L_B$ of the skate boot 22 may be no more than 0.8, in some cases no more than 0.775, in some cases no more than 0.75, in some cases no more than 0.725, and in some cases even less.

Still, in this embodiment, the skate 10 may support the goalie's foot 11 relatively high relative to the ice 14. A support height $H_S$ of the skate 10, which refers to a height from a bottom 50 of the blade 26 to a bottom 52 of the skate boot 22, may be relatively large. For example, in some embodiments, a ratio $H_S/H$ of the support height $H_S$ of the skate 10 over an overall height H of the skate 10 may be at least 0.25, in some cases 0.275, in some cases at least 0.30, in some cases at least 0.325, in some cases at least 0.35, and in some cases even more. The ratio of the support height $H_S$ of the skate 10 over the overall height H of the skate 10 may have any other value in other embodiments. For instance, in some embodiments, the support height $H_S$ of the skate 10 may be at least 70 mm, in some cases at least 75 mm, in some cases at least 80 mm, in some cases at least 85 mm, and in some cases even more. The support height $H_S$ of the skate 10 may have any other value in other embodiments.

In this embodiment, the skate boot 22 comprises a shell 30 and a liner 50. Also, in this embodiment, the skate boot 22 comprises facings 31, a tongue 34, a footbed 38, an insole, and an outsole 42. The skate boot 22 also comprises a strap 43 (e.g., including a hook-and-loop fastener), and eyelets $\mathbf{46}_1$-$\mathbf{46}_E$ extending through the shell 30 and the liner 50 vis-à-vis apertures 48 in order to receive a lace for lacing the skate 10. The shell 30 of the skate boot 22 is a body that imparts strength to the skate boot 22 to support the goalie's foot 11. More particularly, in this embodiment, the shell 30 comprises a heel portion 62 for receiving the heel HL of the goalie 12, an ankle portion 64 for receiving the ankle A of the goalie 12, medial and lateral side portions 66, 68 for facing the medial and lateral sides MS, LS of the goalie's foot 11, respectively, and a toe-covering portion 69 for covering and protecting toes T of the goalie 12. The heel portion 62 may be formed such that it is substantially cup-shaped for following the contour of the heel HL of the goalie 12. The ankle portion 64 comprises medial and lateral ankle sides 74, 76. In this embodiment, the shell 30 comprises two internal projections 91, 93 between the heel portion 62 and the ankle portion 64 to effectively hold or "lock" the heel HL fully inside the heel portion 62 when the goalie 12 wears the skate 10, to increase power transfer from the lower leg of the goalie 12 to the ice. The medial ankle side 74 has a medial depression 78 for receiving the medial malleolus MM of the goalie 12 and the lateral ankle side 76 has a lateral depression 80 for receiving the lateral malleolus LM of the goalie 12. The lateral depression 80 is located slightly lower than the medial depression 78 for conforming to the morphology of the goalie's foot 11. In this example, the shell 30 also comprises a sole portion 69 configured to face the plantar surface PS of the goalie foot 11. The sole portion 69 of the shell 30 constitute at least part of the sole portion 29 of the skate boot 22. The ankle portion 64 may further comprise a rear portion 82 facing the lower part LP of the Achilles tendon AT of the goalie 12. In this example, the skate boot 22 is free of (i.e., without) a tendon guard affixed to the rear portion 82 of the ankle portion 64 and extending upwardly therefrom as is conventionally found in skates for hockey players other than goalies.

In this embodiment, the lateral ankle side 76 of the ankle portion 64 extends lower than the medial ankle side 74 of the ankle portion 64 in the height-wise direction of the skate 10. More specifically, the ankle portion 64 comprises a medial upper edge 45 facing a medial side of the ankle of the goalie's foot 11 and a lateral upper edge 47 facing a lateral side of the ankle of the goalie's foot 11. The lateral upper edge 47 extends lower than the medial upper edge 45 in the height-wise direction of the skate 10 such that the medial upper edge 45 is higher than the lateral upper edge 47 by a vertical offset $D_V$. The lower lateral upper edge 47 may be helpful to relieve pressure on the lateral side LS of the goalie's foot 11 while allowing the goalie 12 to have a deeper stance (i.e., squat closer to the ice 14). Moreover, the higher medial upper edge 45 may provide additional protection and support to the goalie's foot 11. For example, the vertical offset $D_V$ of the lateral upper edge 47 and the medial upper edge 45 of the ankle portion 64 may be at least 10 mm, in some cases at least 15 mm, in some cases at least 20 mm, and in some cases even more.

The vertical offset $D_V$ may be significant relative to the overall height H of the skate 10. For instance, a ratio $D_V/H$ of the vertical offset $D_V$ of the lateral upper edge 47 and the medial upper edge 45 of the ankle portion 64 over the overall height H of the skate 10 may be at least 0.02, in some cases at least 0.04, in some cases at least 0.06, in some cases at least 0.08, and in some cases even more.

With additional reference to FIGS. 6 to 13, in this embodiment, the shell 30 is articulated such that at least part of its ankle portion 64 is movable relative to at least part of its medial side portion 66, at least part of its lateral side portion 68, and at least part of its heel portion 68 when the goalie 12 skates or otherwise moves his/her foot. Notably, in this embodiment, the shell 30 is articulated such that at least part of its ankle portion 64 is movable forwardly relative to at least part of its medial side portion 66, at least part of its lateral side portion 68, and at least part of its heel portion 68 when the goalie 12 flexes his/foot. This enhances a range of motion of the goalie 12 as he/she skates or otherwise moves on the ice 14.

More particularly, in this embodiment, the shell 30 comprises a lower shell member $\mathbf{42}_1$ and an upper shell member 42 that is movable relative to the lower shell member 40. In this example, the lower shell member 40, which may also be referred to as a "main shell member" or "foot covering" of the shell 30, includes at least part of the medial side portion 66 of the shell 30, at least part of the lateral side portion 68 of the shell 30, and at least part of the heel portion 62 of the shell 30, whereas the upper shell member 42, which may also be referred to as a "cuff" of the shell 30, includes at least part of the ankle portion 64 of the shell 30.

More particularly, in this embodiment, the shell 30 comprises a plurality of shell members $\mathbf{42}_1$-$\mathbf{42}p$ connected to one another and movable relative to one another during skating or otherwise moving on the ice 14.

Specifically, in this embodiment, a lower shell member $\mathbf{42}_1$ of the shell members $\mathbf{42}_1$-$\mathbf{42}_P$ which may also be referred to as a "main shell member", a "main foot-covering shell member", or simply a "foot covering" of the shell 30, includes at least part of (i.e. part of or an entirety of) the medial side portion 66 of the shell 30, at least part of the lateral side portion 68 of the shell 30, and at least part of the heel portion 68 of the shell 30. For instance, in some embodiments, the lower shell member $\mathbf{42}_1$ may be configured to cover at least 70%, in some embodiments at least 80%, in some embodiments at least 90%, and in some embodiments even more, of a total surface of the goalie's foot 11 when the goalie wears the skate 10.

The main foot-covering shell member $\mathbf{42}_1$ may have any suitable height. For example, in some embodiments, a ratio of a height HM of the main foot-covering shell member $\mathbf{42}_1$ over a height $H_B$ of the skate boot 22 may be at least 0.4, in some embodiments at least 0.5, in some embodiments at least 0.6, in some embodiments even more (e.g., at least 0.7), in some embodiments no more than 0.8, in some embodiments no more than 0.7, in some embodiments no more than 0.6, and in some embodiments even less (no more than 0.5).

In this embodiment, an upper shell member $\mathbf{42}_2$ of the shell members $\mathbf{42}_1$-$\mathbf{42}_P$, which may also be referred to as a "cuff" of the shell 30, includes at least part of the ankle portion 64 of the shell 30 and is movable relative to the main foot-covering shell member $\mathbf{42}_1$ when the goalie 12 skates or otherwise moves on the ice 14. In this example, the cuff $\mathbf{42}_2$ is pivotable relative to the main foot-covering shell member $\mathbf{42}_1$ when the goalie 12 flexes his/her foot.

The cuff $\mathbf{42}_2$ may have any suitable height. For example, in some embodiments, a ratio of a height $H_C$ of the cuff $\mathbf{42}_2$ over the height $H_B$ of the skate boot 22 may be at least 0.2, in some embodiments at least 0.3, in some embodiments at least 0.4, in some embodiments even more (e.g., at least 0.5), and in some embodiments no more than 0.6, in some embodiments no more than 0.5, in some embodiments no more than 0.4, and in some embodiments even less (e.g., no more than 0.3).

In this embodiment, the main foot-covering shell member $\mathbf{42}_1$ constitutes at least part of the medial and lateral side portions 66, 68 and at least part of the heel portion 62 of the shell 30, while the cuff $\mathbf{42}_2$ constitutes at least part of the ankle portion 64 of the shell 30. More particularly, in this embodiment, the main foot-covering shell member $\mathbf{42}_1$ constitutes an entirety of the medial and lateral side portions 66, 68 and an entirety of the heel portion 62 of the shell 30, while the cuff $\mathbf{42}_2$ constitutes an entirety of the ankle portion 64 of the shell 30.

The main foot-covering shell member $\mathbf{42}_1$ and the cuff $\mathbf{42}_2$ may be designed to have different mechanical properties. For instance, in some embodiments, the main foot-covering shell member $\mathbf{42}_1$ may be stiffer than the cuff $\mathbf{42}_2$. For example, in this embodiment, a thickness of walls forming the main foot-covering shell member $\mathbf{42}_1$ may be different from a thickness of walls forming the cuff $\mathbf{42}_2$. In some embodiments, a ratio of the average thickness of walls forming the main foot-covering shell member $\mathbf{42}_1$ over the average thickness of walls forming the cuff $\mathbf{42}_2$ may be at least 1.1, in some embodiments at least 1.2, in some embodiments at least 1.5, and in some embodiments even more (e.g., at least 2). As another example, the main foot-covering shell member $\mathbf{42}_1$ may comprise a material 72 that makes up at least a substantial part (i.e., a substantial part or an entirety) of the main foot-covering shell member $\mathbf{42}_1$ and that is different from a material 74 of the cuff $\mathbf{42}_2$ which makes up at least a substantial part (i.e., a substantial part or an entirety) of the cuff $\mathbf{42}_2$. In particular, a rigidity of the material 72 may differ from a rigidity of the material 74. In some embodiments, a ratio of the rigidity of the material 72 over the rigidity of the material 74 is at least 1.1, in some embodiments at least 1.5, in some embodiments at least 2, and in some embodiments even more (e.g., at least 3).

In this embodiment, the main foot-covering shell member $\mathbf{42}_1$ and the cuff $\mathbf{42}_2$ are movably connected to one another. Specifically, the main foot-covering shell member $\mathbf{42}_1$ and the cuff $\mathbf{42}_2$ are pivotably connected to one another. In particular, in this embodiment, the shell 30 comprises a pivot 56 disposed between the main foot-covering shell member $\mathbf{42}_1$ and the cuff $\mathbf{42}_2$ to allow them to pivot relative to one another. In this example, the pivot 56 is configured to sit below the medial and lateral malleoli MM, LM and comprises a pair of pivot elements $\mathbf{44}_1$, $\mathbf{44}_2$ that are disposed on respective ones of the medial side portion 66 and the lateral side portion 68 of the shell 30 and collinear. In this example, the pair of colinear pivot elements $\mathbf{44}_1$, $\mathbf{44}_2$ defines a pivot axis 46 of the pivot 56 around which the cuff $\mathbf{42}_2$ pivots relative to the main foot-covering shell member $\mathbf{42}_1$.

Figure 3:
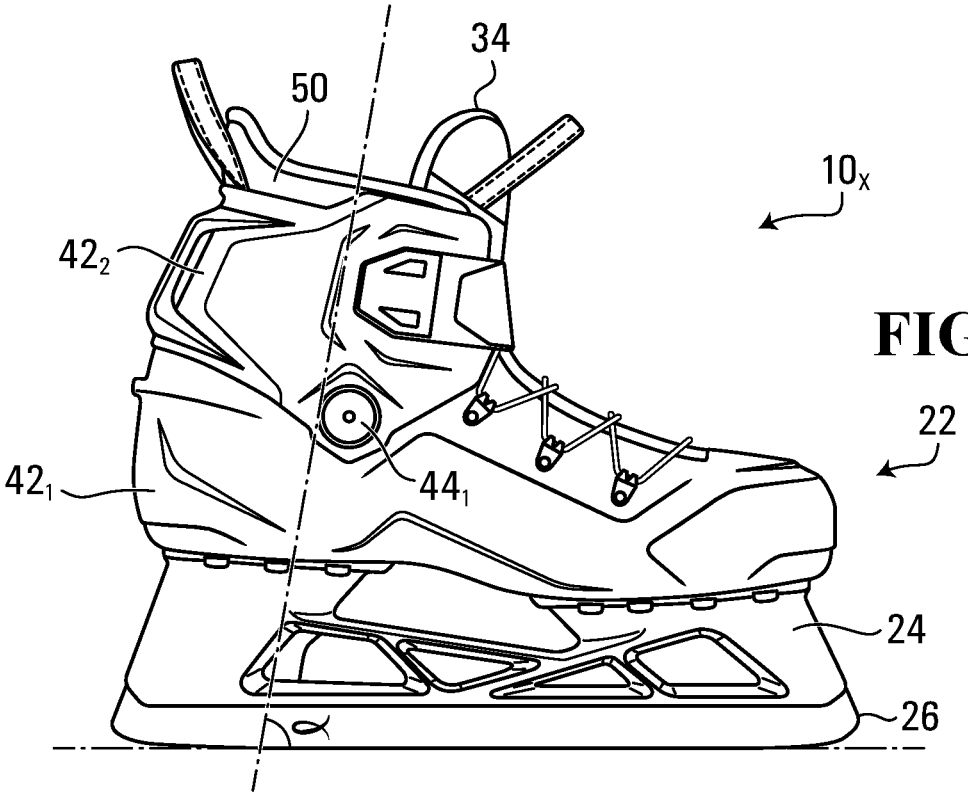
FIGS. 3 and 4 show the goalie skate with the cuff being positioned in various positions relative to the main foot-covering shell element, the blade holder and the blade.
Figure 4:
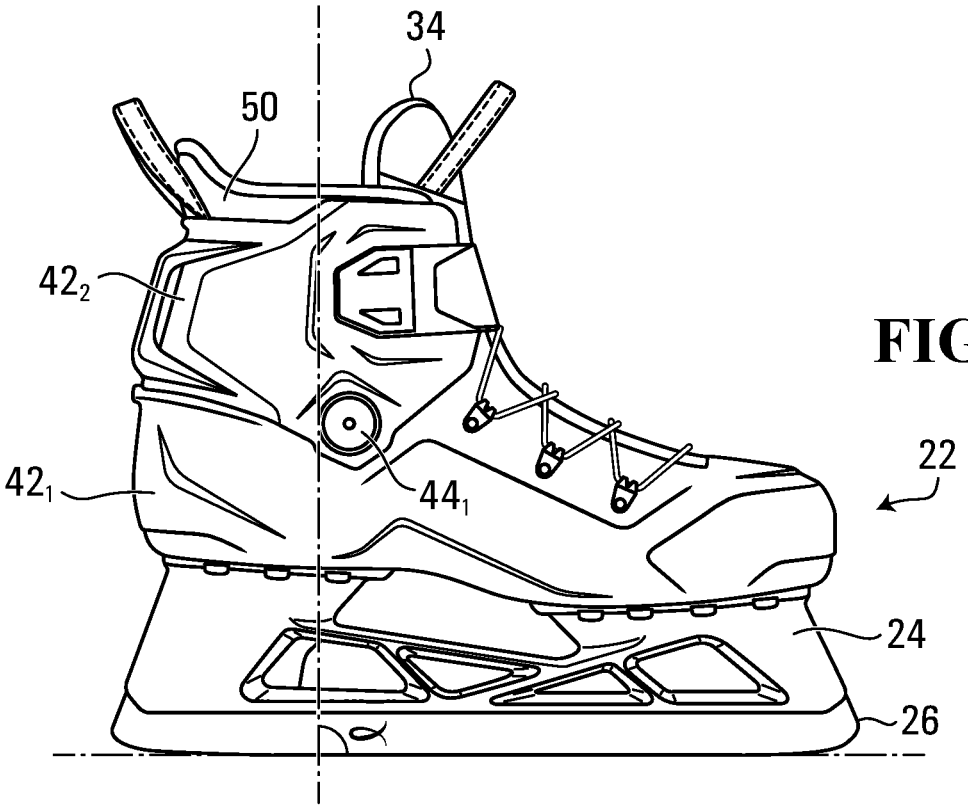

As shown in FIGS. 3 and 4, the main foot-covering shell member $\mathbf{42}_1$ and the cuff $\mathbf{42}_2$ may be pivotably moveable relative to one another only over a pre-determined range of positions which may be characterised by an angle $\alpha$ between a proximal-distal axis of the cuff $\mathbf{42}_2$ and a longitudinal axis of the blade 26 or a longitudinal axis of the blade holder 24 or a longitudinal axis of the main foot-covering shell member $\mathbf{42}_1$. At the extreme positions of the pre-determined range of positions, the pivots $\mathbf{44}_1$, $\mathbf{44}_2$ may prevent the main foot-covering shell member $\mathbf{42}_1$ and the cuff $\mathbf{42}_2$ from rolling relative to one another in the respective direction which would bring the main foot-covering shell member $\mathbf{42}_1$ and the cuff $\mathbf{42}_2$ to be in a relative position that would be outside of the pre-determined range of positions, and/or the main foot-covering shell member $\mathbf{42}_1$ and the cuff $\mathbf{42}_2$ may interface with one another to create a similar effect.

The shell 30 may have any suitable pre-determined range of positions. In some embodiments, the pre-determined range of positions may span at least 15°, in some embodiments at least 20°, in some embodiments at least 25°, and in some embodiments even more (e.g., at least 45°).

This may enable the goalie to be more agile by improving the range of motion of the goalie's lower legs and ankle while the goalie wears the skate without compromising performances (e.g., power transfer from the goalie's leg and ankle to the ice, reactiveness of the skate, etc.). Notably, in traditional skates, the range of motion of the goalie's lower leg relative to the skate principally depends on tightness and stiffness of the skate boot over the goalie's foot and ankle, and increasing tightness and stiffness of the skate boot diminishes the range of motion of the goalie's lower leg relative to the skate. In this embodiment, the shell 30 may enable an increased range of motion of the goalie's lower leg relative to the main foot-covering shell member $\mathbf{42}_1$ without compromising tightness and stiffness of the skate boot 22 over the goalie's foot and ankle. More specifically, in this embodiment, the goalie skate 10 is configured to allow movement of the lower leg of the goalie relative to the main foot-covering shell member $\mathbf{42}_1$, the blade holder 24 and the blade 26 when the hockey goalkeeper wears the goalie skate 10 and while the lower leg of the hockey goalkeeper does not move relative to the cuff $\mathbf{42}_2$. In particular, the goalie skate 10 may allow movement of the lower leg of the goalie relative to the main foot-covering shell member $\mathbf{42}_1$, the blade holder 24 and the blade 26 while the lower leg of the hockey goalkeeper does not move relative to the cuff $\mathbf{42}_2$ over a range of positions that corresponds to the pre-determined range of positions of the shell 30.

In this embodiment, at least part of (i.e. part of or an entirety of) the shell 30 may be thermoformable about the goalie's foot 11 such that such that the shell 30 can be heated to a pre-determined temperature at which an original shape of the shell 30 can be altered into an altered shape and can keep its altered shape after cooling down. More specifically, in this embodiment, at least part of the main foot-covering shell member $\mathbf{42}_1$ and at least part of the cuff $\mathbf{42}_2$ are thermoformable about the goalie's foot 11. More specifically, in this embodiment, at least a majority of (i.e. a majority of or an entirety of) the main foot-covering shell member $\mathbf{42}_1$, at least a majority of the cuff $\mathbf{42}_2$ are thermoformable about the goalie's foot 11, and at least part of the shell 30 is non-thermoformable. More specifically, in this embodiment, at least part of the medial side portion 66, at least part of the lateral side portion 68, at least part of the heel portion 62, and at least part of the ankle portion 64 of the shell 30 are thermoformable about the goalie's foot 11, and the toe-covering portion 69 is non-thermoformable. To achieve this, the shell 30 may comprise one or more different thermoformable materials (e.g. at the medial side portion 66, the lateral side portion 68, the heel portion 62, and/or the ankle portion 64) and one or more different non-thermoformable materials (e.g., at the toe-covering portion 69).

Figure 15:
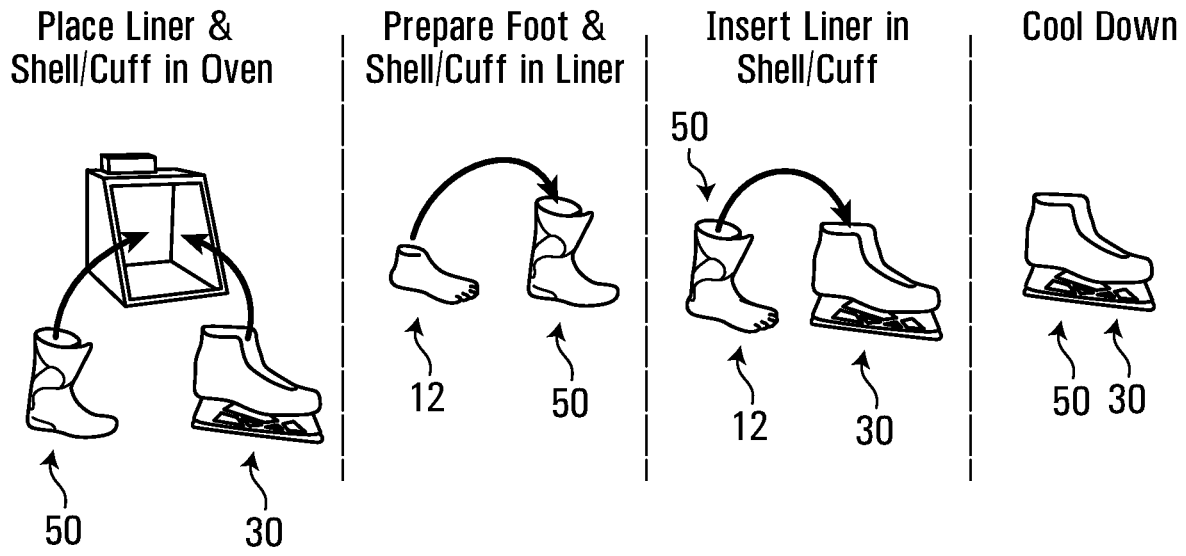
FIG. 15 shows a customization method of the shell and the liner.

Practically, as shown in FIG. 15, in this embodiment, the skate 10 having a specific size (e.g. 8.5D, 8.5DD, 8.5E, 9.0D, etc.) may be sold with the shell 30 defining a cavity that is smaller in some aspects than 50%, 75%, 90% or 95% of the foots of this specific size. The skate 10 may then be heated to the pre-determined temperature (e.g., at least 45°, at least 50°, at least 55°, at least 60°, at least 65°, at least 70°, at least 75°, at least 80°, at least 85°, at least 90°, at least 100°, at least 110°) and be tightly worn by the hockey goalkeeper during a pre-determined time (e.g., at least 5 minutes, at least 10 minutes, at least 15 minutes, at least 20 minutes, at least 30 minutes), such that the original shape of the shell 30 is customably altered to conform to the goalie foot 11.

Thermoformability (i.e., a degree of ease with which that portion can be thermoformed, higher thermoformability entailing that less energy is needed to achieve a given level of deformation or more deformation is achieved with a given level of energy) of the materials of the shell 30 may be different between two different thermoformable portions of the shell 30. For example, thermoformabilities of the materials of the medial and lateral side portions 66, 68 and ankle portion 64 of the shell 30 may be greater than a thermoformability of the material of the heel portion 62 of the shell 30.

In this embodiment, the shell 30 may also comprise portions $\mathbf{160}_1$-$\mathbf{160}_P$ where an internal surface 162 of the shell 30 can be punched to plastically deform the shell 30, for example to enlarge the cavity 54 of the skate boot 22 at the respective portions $\mathbf{160}_1$-$\mathbf{160}_P$. More specifically, in this embodiment, the internal surface 162 of the main foot-covering shell member $\mathbf{42}_1$ comprises a punchable portion $\mathbf{160}_1$ that is configured to cover a medial metatarsus of the goalie foot 11, a punchable portion $\mathbf{160}_2$ that is configured to cover a lateral metatarsus of the goalie foot 11, and a punchable portion $\mathbf{160}_3$ that is configured to face the plantar surface PS of the goalie foot 11, and the cuff $\mathbf{42}_2$ comprises a punchable portion $\mathbf{160}_4$ that is configured to cover the medial malleolus MM and a punchable portion $\mathbf{160}_5$ that is configured to cover the lateral malleolus LM.

In this embodiment, the skate 10 may be cowlingless, i.e., free of (i.e., without) any cowling (i.e., hard cover) covering a toe area 31, a heel area 33, a lower medial area 35, and a lower lateral area 37 of the skate boot 22. This contrasts with conventional goalie skates, which comprise a cowling covering a toe area, a heel area, a lower medial area, and a lower lateral area of a skate boot.

By being cowlingless, in this embodiment, the skate 10 may facilitate the thermoforming and/or punching capabilities of the shell 30, by avoiding a structure which would restraint the thermoforming capability of the shell 30 and/or which would also need to be customably adapted to properly fit the altered shape of the shell 30.

Figure 5:
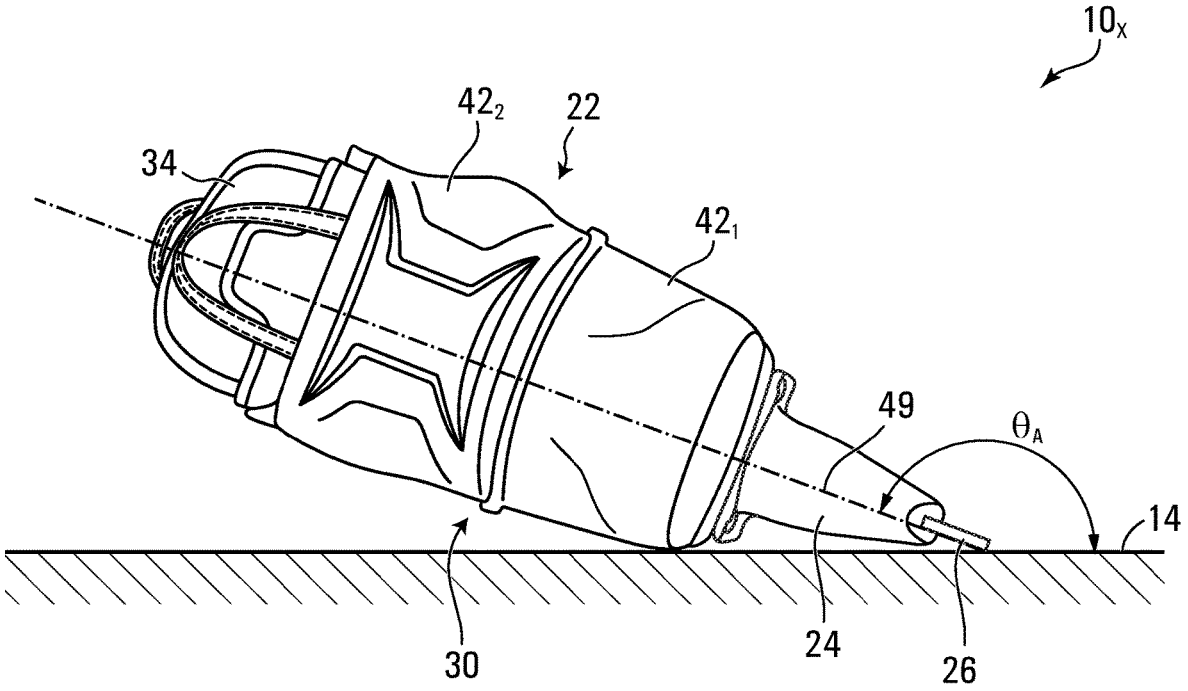
FIG. 5 shows a rear view of the goalie skate when the goalie skate engages a playing surface at a maximal attack angle.
Figure 6:
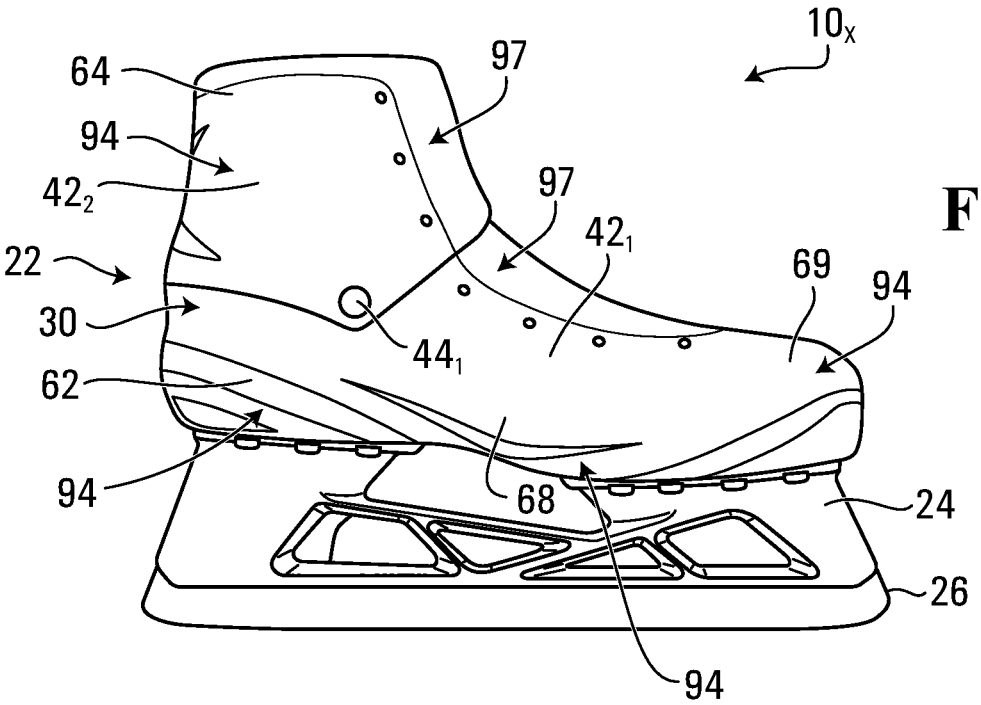
FIGS. 6 to 9 show side views, a top view and a front view of the goalie skate without the liner.
Figure 7:
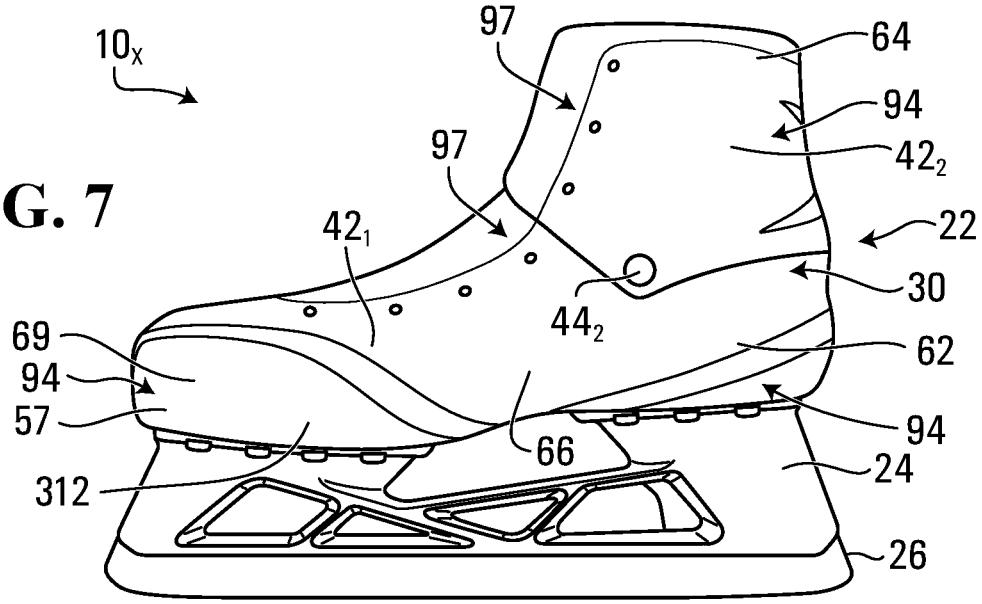
Figure 8:
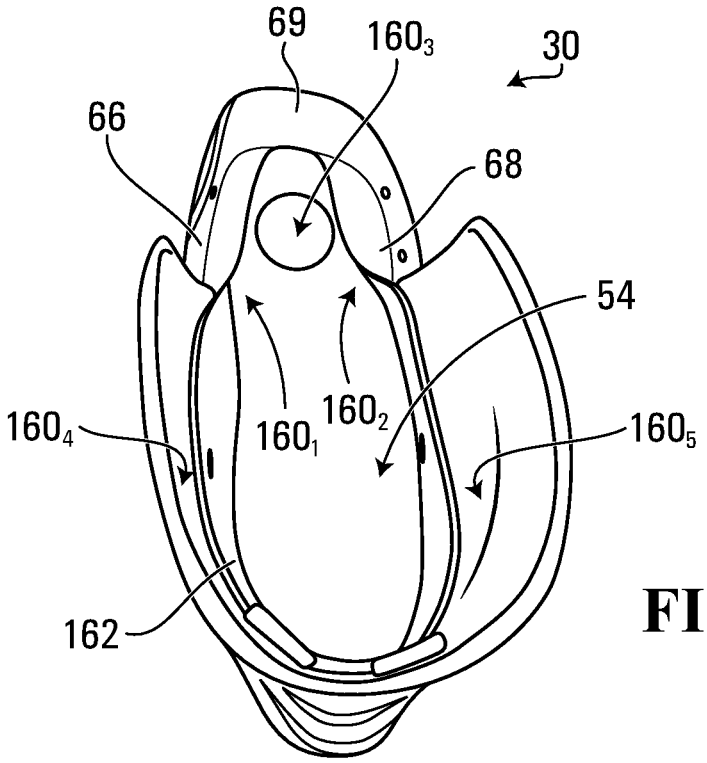
Figure 9:
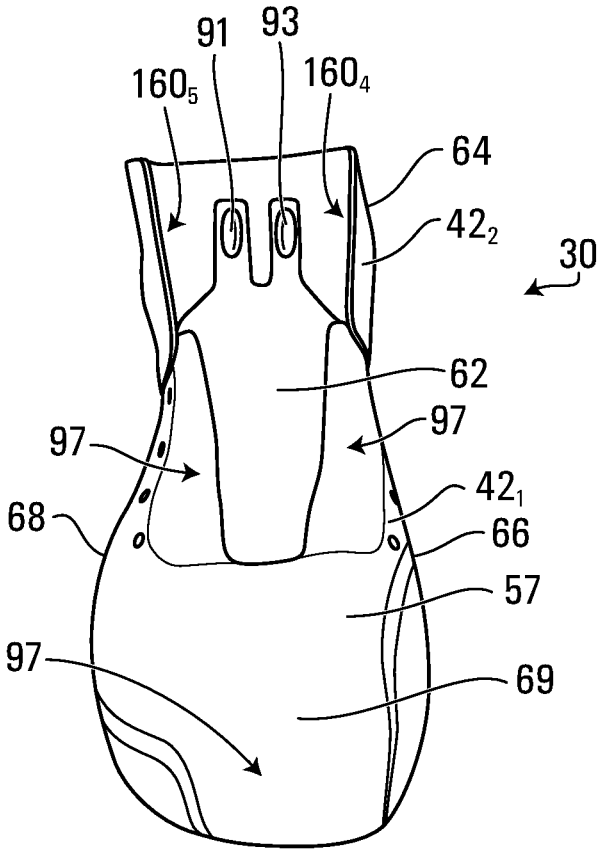
Figure 10:
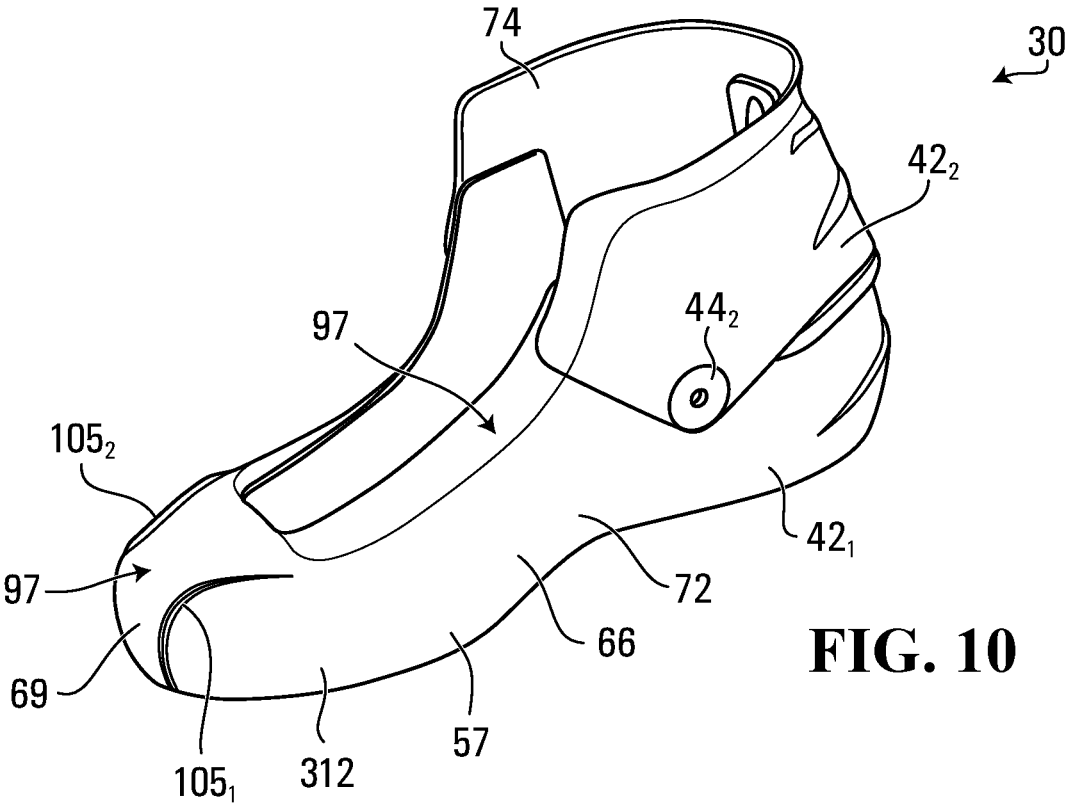
FIGS. 10 to 13 show perspective views of the shell.
Figure 11:
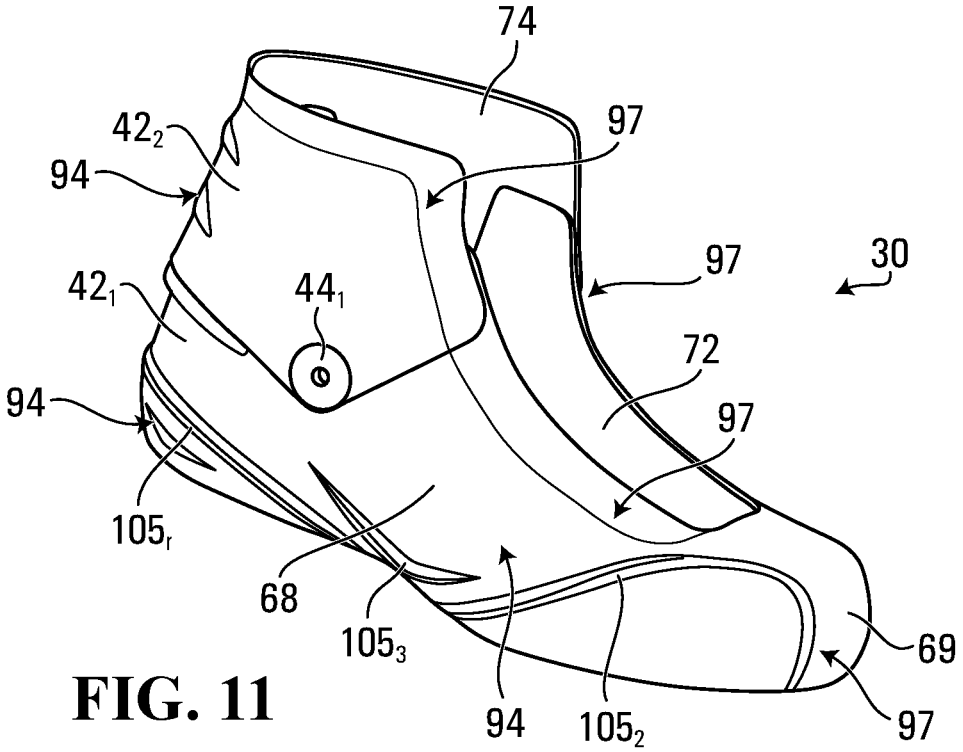
Figure 12:
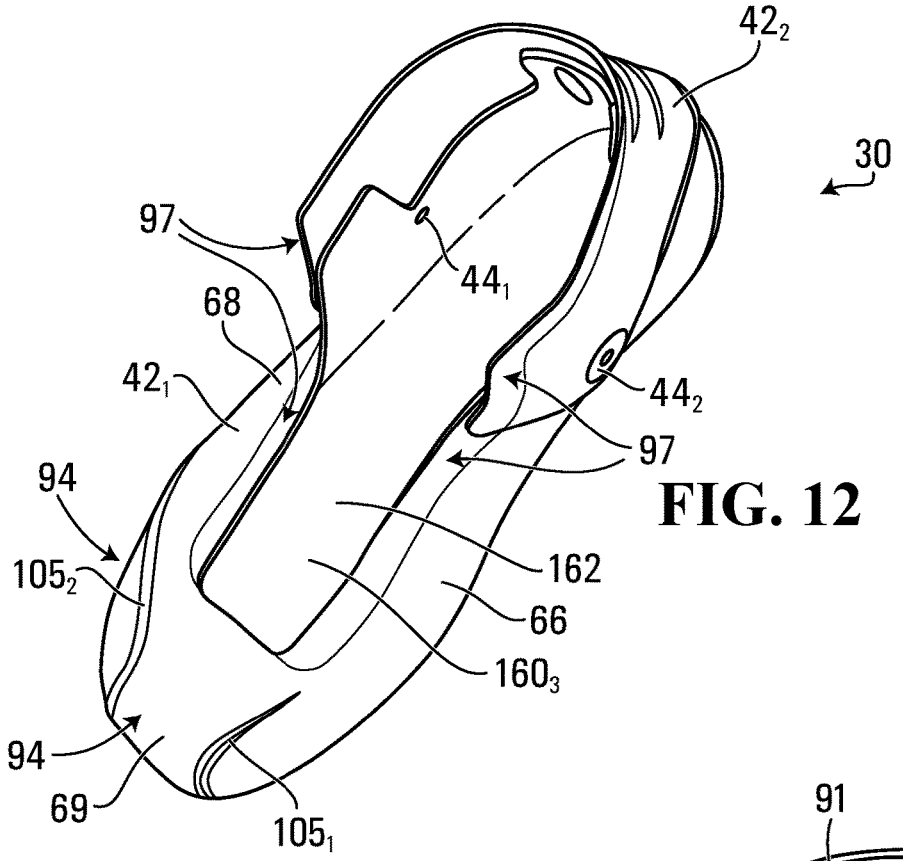
Figure 13:
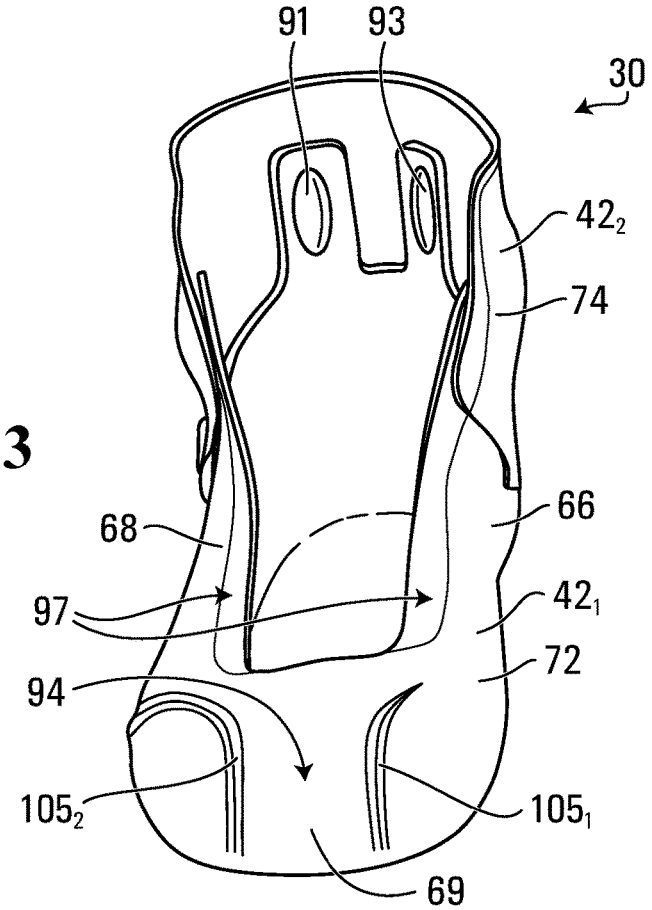

By being cowlingless, in this embodiment, as shown in FIG. 5, the skate 10 may also allow an angle of attack $\theta_A$ with the ice 14 that can be larger (e.g., greater than for conventional hockey goalkeeper skates with cowlings). The angle of attack $\theta_A$ of the skate 10 with the ice 14 refers to an angle between the ice 14 and a plane 49 of the blade 26 when the skate 10 is inclined relative to the ice 14 such that a medial surface of the skate 10 touches the ice 14. Allowing the angle of attack $\theta_A$ of the skate 10 with the ice 14 to be larger may help the goalie 12 to execute quicker and harder pushes against the ice 14. For example, in some embodiments, the angle of attack $\theta_A$ of the skate 10 with the ice 14 may be at least 140°, in some cases at least 142°, in some cases at least 145°, in some cases at least 148°, in some cases at least 150°, and in some cases even more. The angle of attack $\theta_A$ of the skate 10 with the ice 14 may have any other value in other embodiments.

As the skate 10 is cowlingless, in this embodiment, the main foot-covering shell member $\mathbf{42}_1$ and the cuff $\mathbf{42}_2$ of the shell 30 comprise a plurality of zones that are more or less exposed to flying pucks during play. For instance, in this embodiment, a bottom region 84 of the lateral side portion 68 of the shell 30, a bottom region 86 of the medial side portion 66 of the shell 30, a bottom region 88 of the heel portion 62 of the shell 30, and a bottom region 90 of the toe covering portion 32 are exposed. This is in contrast to the conventional skate for a hockey goalie, in which such bottom regions are covered by a cowling.

To appropriately protect the goalie foot 11 while remaining exposed (i.e., without any cowling covering it), the shell 30 may be reinforced where exposed to impact with a puck during play. That is, in view of an absence of a cowling in the skate 10, the shell 30 is reinforced in one or more zones of the shell 30 expected to be impacted by a puck during play in order to properly protect the goalie's foot 11. To that end, the shell 30 comprises reinforced zones 94 exposed to impact with a puck during play. The reinforced zones 94 of the shell 30 may be strengthened to take into account the absence of a cowling in the skate 10. For instance, the reinforced zones 94 of the shell 30 may have a material composition (e.g., a different, stronger material or an additional material) and/or a shape (e.g., a thicker area) that makes that part of the shell 30 more protective. Consequently, the stiffness of the shell 30 may vary for different zones of the shell 30, e.g., a stiffness of a given one of the reinforced zones 94 may be different from a stiffness of a given one of non-reinforced zones 97. In this example of implementation, the reinforced zones 94 of the shell 30 do not extend over an entirety of the shell 30 such that the reinforced zones 94, which may be more likely to be impacted by a puck during play, may provide more impact protection (e.g., be stronger and/or able to absorb more energy from impacts) than non-reinforced zones 97 of the shell 30 that are outside of the reinforced zones 94 and that may be less likely to be impacted by a puck during play.

In this embodiment, the reinforced zones 94 of the shell 30 comprise at least part of the medial and lateral side portions 66, 68 of the shell 30 and at least part of the heel portion 62 of the shell 30. For instance, the reinforced zone 94 comprises the bottom region 84 of the lateral side portion 68, the bottom region 86 of the medial side portion 66, and the bottom region 88 of the heel portion 62 of the shell 30.

For instance, in this embodiment, the reinforced zones 94 of the shell 30 have a thickness $T_R$ that is greater than a thickness $T_{NR}$ of the non-reinforced zones 97 of the shell 30. For instance, in some embodiments, a ratio $T_R/T_{NR}$ of the thickness $T_R$ of the reinforced zones 94 of the shell 30 over the thickness $T_{NR}$ of the non-reinforced zones 97 of the shell 30 may be at least 1.1, in some cases at least 1.2, in some cases at least 1.5, in some cases at least 2, and in some cases even more. This ratio may have any other suitable value in other embodiments. For example, in some embodiments, the thickness $T_R$ of the reinforced zones 94 of the shell 30 may be at least 4 mm, in some cases at least 6 mm, in some cases at least 8 mm, in some cases at least 10 mm, and in some cases even more, while in some embodiments, in order to be less bulky, less heavy and less brittle, the thickness $T_R$ of the reinforced zones 94 of the shell 30 may be no more than 12 mm, in some embodiments no more than 10 mm, in some embodiments no more than 8 mm, and in some embodiments even less (e.g., no more than 7 mm). In comparison, in some embodiments, the thickness $T_{NR}$ of the non-reinforced zones 97 of the shell 30 may be at least 2 mm, in some cases at least 3 mm, in some cases at least 4 mm, and in some cases even more, while in some embodiments, in order to be less bulky and less heavy, the thickness $T_{NR}$ of the non-reinforced zones 97 of the shell 30 may be no more than 6 mm, in some embodiments no more than 4 mm, in some embodiments no more than 3 mm, and in some embodiments even less (e.g., no more than 2 mm). The thickness $T_R$ of the reinforced zones 94 of the shell 30 may have any other suitable value in other embodiments.

For example, in some embodiments, a thickness of the lateral side portion 68 of the shell 30 may be at least 6 mm, in some cases at least 7 mm, in some cases at least 8 mm, in some cases at least 9 mm, and in some cases even more. In some embodiments, the thickness of the lateral side portion 68 of the shell 30 may be greater than a thickness of the medial side portion 66 of the shell 30. As another example, a thickness of the heel portion 62 of the shell 30 may be at least 6 mm, in some cases at least 7 mm, in some cases at least 8 mm, in some cases at least 9 mm, and in some cases even more. In some embodiments, the thickness of the heel portion 62 of the shell 30 may be greater than the thickness of the medial side portion 66 of the shell 30.

The reinforced zones 94 may be significantly stiffer and/or harder than the non-reinforced zones 97. For instance, in some embodiments, a ratio of a modulus of elasticity of a given one of the reinforced zones 94 (e.g., over the lateral side portion 68 of the shell 30) over a modulus of elasticity of a given one of the non-reinforced zones 97 (e.g., over the medial side portion 66 of the shell 30) may be, in some cases, at least a 1.1, in some cases at least 1.2, in some cases at least 1.3, in some cases at least 1.4, in some cases at least 1.5, in some cases at least 2 and in some cases even more.

In some embodiments, only limited extents of the lateral side portion 68, the medial side portion 66, and/or the heel portion 62 of the shell 30 may be reinforced.

For example, in some embodiments, the reinforced portion 94 of the lateral side portion 68 may only span limited extents of the lateral side portion 68 such that a thickness of the lateral side portion 68 may vary. For instance, a thickness of a first area 113 corresponding to the reinforced zone 94 of the lateral side portion 68 of the shell 30 may be greater than a thickness of a second area 117 corresponding to the non-reinforced zone 97 of the lateral side portion 68 of the shell 30. The first area 113 of the lateral side portion 68 of the shell 30 may be lower than the second area 117 of the lateral side portion 68 in the height-wise direction of the skate 10. For instance, a ratio of the thickness of the first area 113 of the lateral side portion 68 over the thickness of the second area 117 of the lateral side portion 68 may be at least 1.1, in some cases at least 1.2, in some cases at least 1.3, and in some cases even more. For example, a thickness of the bottom region 84 of the lateral side portion 68 may be greater than a thickness of an upper region 87 of the lateral side portion 68 of the shell 30. A stiffness and/or a hardness of the lateral side portion 68 may vary. For instance, a stiffness of the first area 113 corresponding to the reinforced zone 94 of the lateral side portion 68 of the shell 30 may be greater than a stiffness of the second area 117 corresponding to the non-reinforced zone 97 of the lateral side portion 68 of the shell 30. For instance, a ratio of the stiffness of the first area 113 of the lateral side portion 68 over the stiffness of the second area 117 of the lateral side portion 68 may be at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2, and in some cases even more. For example, a stiffness of the bottom region 84 of the lateral side portion 68 may be greater than a stiffness of an upper region 87 of the lateral side portion 68 of the shell 30.

As another example, in some embodiments, the reinforced portion 94 of the heel portion 62 may only span limited extents of the heel portion 62 such that a thickness of a first area 119 corresponding to the reinforced zone 94 of the heel portion 62 of the shell 30 may be greater than a thickness of a second area 121 corresponding to the non-reinforced zone 97 of the heel portion 62 of the shell 30. The first area 119 of the heel portion 62 of the shell 30 may be lower than the second area 121 of the heel portion 62 in the height-wise direction of the skate 10. For instance, a ratio of the thickness of the first area 119 of the heel portion 62 over the thickness of the second area 121 of the heel portion 62 may be at least 1.1, in some cases at least 1.2, in some cases at least 1.3, and in some cases even more. For example, a thickness of the bottom region 88 of the heel portion 62 may be greater than a thickness of an upper region 123 of the heel portion 62 of the shell 30. A stiffness and/or a hardness of the first area 119 corresponding to the reinforced zone 94 of the heel portion 62 of the shell 30 may be greater than a stiffness and/or a hardness of the second area 121 corresponding to the non-reinforced zone 97 of the heel portion 62 of the shell 30. For instance, a ratio of the stiffness of the first area 119 of the heel portion 62 over the stiffness of the second area 121 of the heel portion 62 may be at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2, and in some cases even more. For example, a stiffness of the bottom region 88 of the heel portion 62 may be greater than a stiffness of an upper region 123 of the heel portion 62 of the shell 30.

While in this embodiment the thickness $T_R$ of the reinforced zones 94 of the shell 30 is greater than the thickness $T_{NR}$ of the non-reinforced zones 97 of the shell 30, the thickness $T_R$ of the reinforced zones 94 of the shell 30 is comparatively small in relation to a sum of thicknesses of the cowling 515 and a shell 530 of the skate boot 522 of the conventional goalie skate 510. In view of this relatively small thickness $T_R$ of the reinforced zones 94, a "lower foot-facing width" WB of the skate 10 may be smaller than a lower-foot-facing width of the conventional goalie skate 510. The lower-foot-facing width WB of the skate 10 is a width of the skate 10 measured in a lower portion of the skate boot 22 that faces the lateral and medial sides LS, MS of the goalie's foot 11. For instance, the lower-foot-facing width WB of the skate 10 may be measured at a bottommost two-inch extent of the skate boot 22. That is, the lower-foot-facing width WB of the skate 10 is a maximal width of the skate 10 measured between the bottom 52 of the skate boot 22 and a point two inches above the bottom 52 of the skate boot 22 in the height-wise direction of the skate 10. For example, in some embodiments, for a North American size 8 D senior goalie skate (i.e., a regular width size 8 senior goalie skate), the lower-foot-facing width WB of the skate 10 may be no more than 80 m, in some cases no more than 70 mm, in some cases no more than 60 mm, and in some cases even less. Moreover, regardless of a size designation of the skate 10, in some embodiments, a ratio of the lower-foot-facing width WB of the skate 10 over the overall height H of the skate 10 may be no more than 0.35, in some cases no more than 0.325, in some cases no more than 0.3, in some cases no more than 0.275, in some cases no more than 0.25, and in some cases even less.

In this embodiment, the skate boot 22 comprises a gliding portion 312 where an external surface 57 of the skate boot 22 is smooth to facilitate gliding on the ice during lateral displacements of the goalie. In particular, the gliding portion 312 may be located on the medial side 66 of the shell 30, and may be configured to cover the medial metatarsus MM of the hockey goalkeeper.

The external surface 57 of the portion may have a surface finish that facilitates gliding on ice and reduces a friction coefficient on ice, e.g., by being smoother than a surface finish of a lateral part of the toe portion. In some embodiment, a friction coefficient on ice at −7° C. may be less than 0.15, in some embodiments less than 0.10, in some embodiments less than 0.05, and in some embodiments even less (e.g., less than 0.03).

In this embodiment, the shell comprises a plurality of ribs $\mathbf{105}_1$-$\mathbf{105}_r$. The ribs $\mathbf{105}_1$, $\mathbf{105}_2$ may be torsional ribs which contributing to a torsional stiffness of the skate boot 22 in addition to providing impact protection by dissipating energy of an impact with a flying puck when the impact occurs on the impact rib $\mathbf{105}_1$ or $\mathbf{105}_2$ and/or by spreading energy of an impact with a flying puck when the impact occurs on the impact rib $\mathbf{105}_1$ or $\mathbf{105}_2$. The ribs $\mathbf{105}_1$, $\mathbf{105}_2$ may extend from the medial and lateral side portions 66, 68 to the front of the skate boot 22 (e.g. to a front portion of the toe covering portion 32 of the skate boot 22). The rib $\mathbf{105}_3$ may be a post protector or an impact rib to provide protection by spreading energy of an impact with a goal post when the goalie moves laterally to protect the goal. In order to contribute to stiffness and/or dissipate or spread impact energy, the ribs $\mathbf{105}_1$, $\mathbf{105}_2$, $\mathbf{105}_3$ may have suitable dimensions. For example, in this embodiment, a maximal width of the ribs is at least 1 mm, in some embodiments at least 3 mm, in some embodiments 5 mm and a maximal height of the ribs is at least 1 mm, in some embodiments at least 2 mm, in some embodiments 2.5 mm.

In this embodiment, the shell 30 comprises synthetic materials 72, 74 that makes up at least a substantial part (i.e., a substantial part or an entirety) of the shell 30. In this embodiment, the synthetic materials 72, 74 are polymeric materials. For example, in some embodiments, the polymeric materials 72, 74 may include polypropylene. In some cases, the polymeric materials 72, 74 may be a foam. For instance, in some cases, the polymeric materials 72, 74 may include an ethylene-vinyl acetate (EVA) foam or any other suitable foam. The polymeric materials 72, 74 may include any other suitable polymer in other embodiments (e.g., nylon, polyester, vinyl, polyvinyl chloride, an ionomer resin (e.g., Surlyn®), ultrahigh impact polypropylene, TPO, TPU, SEBS/PP, styrene-butadiene copolymer (e.g., K-Resin®) etc.). In some examples of implementation, the polymeric materials 72, 74 may be polymer-matrix composite materials (e.g., in which fibers are embedded in a polymer matrix). For instance, in some embodiments, the polymeric materials 72, 74 may comprise self-reinforced polymer composites, such as self-reinforced polypropylene composite (e.g., Curve®). The synthetic materials 72, 74 may be implemented in any other suitable way in other embodiments (e.g., other types of polymers, other types of composite material, etc.).

In this example of implementation, the synthetic materials 72, 74 of the shell 30 are molded material. That is, the synthetic materials 72, 74 of the shell 30 are formed by a molding process in a mold. An original shape of each one of the synthetic materials 72, 74 of the shell 30 is thus a molded shape imparted during the molding process. More particularly, in this example of implementation, the synthetic materials 72, 74 of the shell 30 are thermoformed material. More particularly, in this example of implementation, the synthetic materials 72, 74 of the shell are thermoformable and remain thermoformable after being initially thermoformed and molded into their respective original shape. For instance, a sheet of a respective one of the synthetic materials 72, 74 may be heated (e.g., in an oven) until it reaches a pliable forming temperature. The sheet of the respective one of the synthetic materials 72, 74 is then formed via a mold to have a shape of the shell 30. Once the synthetic materials 72, 74 have cooled and any excess material has been trimmed, the shell 30 is complete, has its original shape and is ready for assembly with other components of the skate 10. In other examples of implementation, the synthetic materials 72, 74 of the shell 30 may be molded in any other suitable way (i.e., injection molded).

The synthetic materials 72, 74 of the shell 30 may be relatively rigid, i.e., may have relatively high moduli of elasticity (i.e., Young's modulus). For example, in some embodiments, the moduli of elasticity of the synthetic materials 72, 74 may be at least 4 GPa, in some cases at least 4.5 GPa, in some cases at least 5 GPa, in some cases at least 5.5 GPa, and in some cases even more. The moduli of elasticity of the synthetic materials 72, 74 of the shell 30 may have any other suitable value in other embodiments.

The synthetic materials 72, 74 of the shell 30 may be relatively hard and impact resistant. For instance, synthetic materials 72, 74 may not break during a Charpy impact strength test (−30° C., ISO 179).

The overlay 95 comprises a synthetic material 104 for imparting protection to the goalie's foot 11. More particularly, in this embodiment, the synthetic material 104 is more compliant (i.e., elastically deformable) than the synthetic materials 72, 74 of the shell 30 such that the synthetic material 104 is capable of absorbing energy from impacts better than the synthetic materials 72, 74. To that end, a modulus of elasticity (i.e., Young's modulus) of the synthetic material 104 may be smaller than the modulus of elasticity of the synthetic materials 72, 74. For example, a ratio of the modulus of the synthetic material 104 of the overlay 95 over the modulus of the synthetic materials 72, 74 may be, in some cases, no more than 0.9, in some cases no more than 0.8, in some cases no more than 0.7, in some cases no more than 0.6 and in some cases even less.

Furthermore, in this embodiment, the synthetic material 104 of the overlay 95 has a thickness $T_O$ that is different from a thickness $T_B$ of the synthetic materials 72, 74 of the shell 30. More particularly, in this embodiment, the thickness $T_O$ of the synthetic material 104 of the overlay 95 is less than the thickness $T_B$ of the synthetic materials 72, 74. For instance, in some embodiments, a ratio $T_O/T_B$ of the thickness $T_O$ of the synthetic material 104 of the overlay 95 over the thickness TB of the synthetic materials 72, 74 may be no more than 0.25, in some cases no more than 0.2, in some cases no more than 0.15, and in some cases even less.

Figure 14:
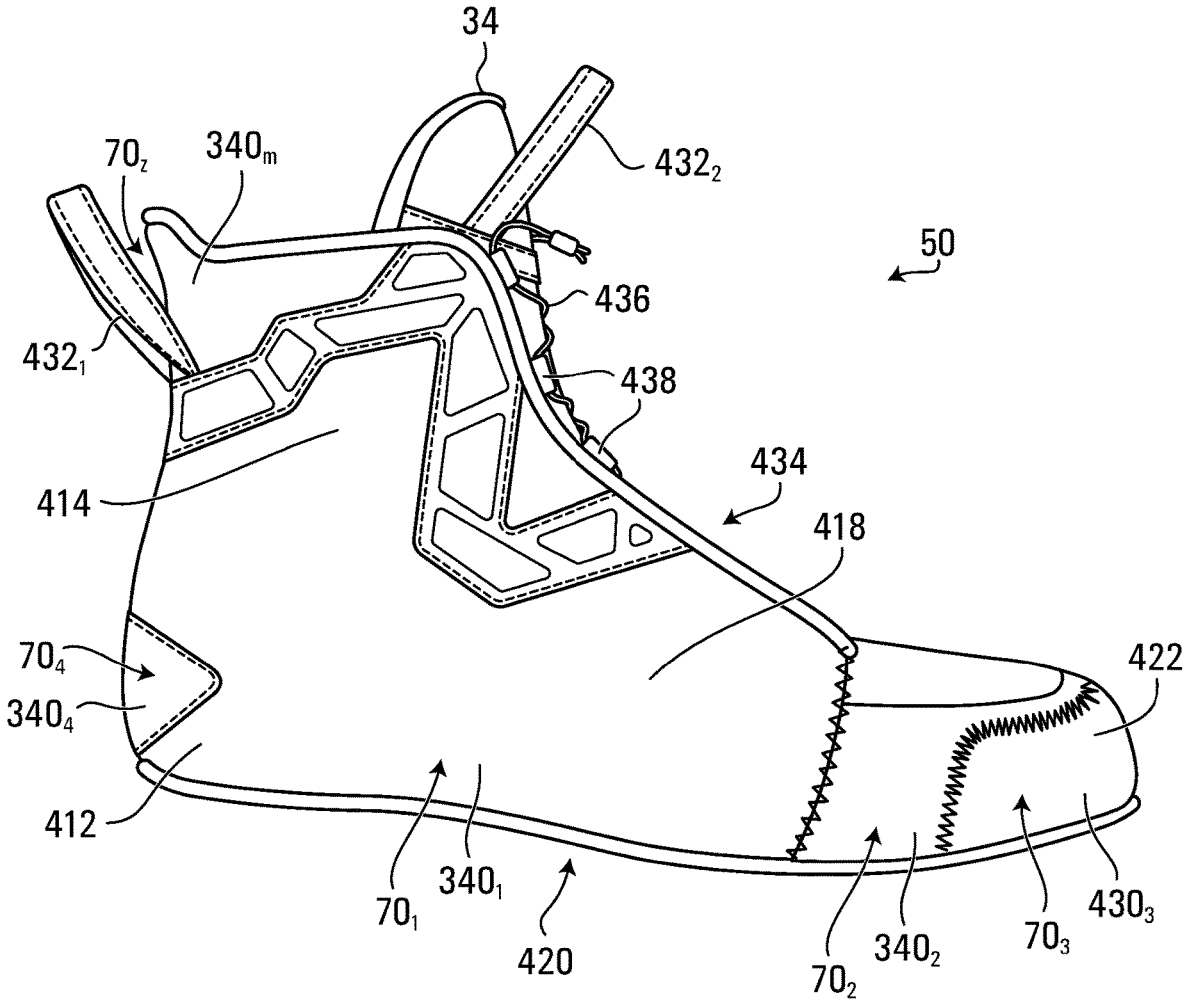
FIG. 14 shows a side view of the liner.

As shown in FIG. 14, in this embodiment, the liner 50 is provided to enhance fit of the skate boot 22 and/or comfort of the goalie's foot 11. More particularly, in this embodiment, the liner 50 may comprise an inner surface 96 for facing the heel HL, the medial and lateral sides MS, LS, the ankle A and the plantar surface PS of the goalie's foot 11 in use. The liner 50 is disposed within the shell 30, i.e., in an interior 49 of the shell 30. In particular, in this embodiment, the liner 50 may be connectable and removably disposed within the shell 30, i.e., disposed in the interior 49 of the shell 30 and configured to be removable from the interior 49 of the shell 30.

In this embodiment, the liner 50 may comprise a medial side portion 416 for facing the medial side MS of the goalie's foot 11, a lateral side portion 418 for facing the lateral side LS of the goalie's foot 11, a heel portion 412 for facing the heel HL of the goalie 12, an ankle portion 414 for receiving the ankle A of the goalie 12, a sole portion 420 for facing the plantar surface PS of the goalie 12, a toe covering portion $\mathbf{42}_2$ for covering the toes T of the goalie 12, an instep portion 424 configured to face the instep IN of the player's foot and a tongue 34 connected to the toe covering portion $\mathbf{42}_2$ for protecting the top surface TS of the goalie foot 11. The liner 50 may further comprise straps 4321, 4322 respectively connected to the ankle portion 414 and to the tongue 34 to facilitate manipulation and adjustment of the liner 50 of the goalie foot 11 and/or in the shell 30. In this embodiment, the liner 50 comprises an elastic 434 which helps limiting an extent of a top opening between the medial and lateral side portions 416, 418, where the tongue 34 is located. In other embodiments, the liner 50 may comprise any other fastening system (e.g., a lace 436 and lacing openings 438 arrangement, the lacing openings 438 being configured for receiving the lace 436) in order to do so.

In this embodiment, the liner 50 may extend higher than the cuff $\mathbf{42}_2$ of the shell 30 such that the liner 50 defines the highest point of the skate 10. For instance, when the liner 50 is inside the shell 30, the ankle portion 414 of the liner 50 may protrude from the ankle portion 64 of the shell 30 by at least 1 mm, in some embodiments by at least 2 mm, in some embodiments by at least 5 mm, in some embodiments by at least 10 mm, in some embodiments by at least 15 mm, in some embodiments by even more (e.g., at least 20 mm).

In this embodiment, at least part of (i.e. part of or an entirety of) the liner 50 may be compressible, thermoformable and thermoexpandable such that the liner 50 can be heated to a pre-determined temperature at which the liner 50 will expand and an original shape of the liner 50 can be altered (e.g., compressed) into an altered shape and can keep its altered shape after cooling down. For instance, in this embodiment, at least part of the medial side portion 416, at least part of the lateral side portion 418, at least part of the heel portion 412, at least part of the sole portion 420, and at least part of the instep portion 424 of the liner 50 are compressible, thermoformable and thermoexpandable, and at least part of the toe covering portion $\mathbf{42}_2$ of the liner 50 is non-thermoformable. As such, in this embodiment, the liner 50 may comprise thermoformable, thermoexpandable portions and non-thermoformable, non-thermoexpandable portions. More particularly, in this embodiment, some of the thermoformable, thermoexpandable portions of the liner 50 are configured to underly respective thermoformable portions of the shell 30 such that thermoformable portions of the shell 30 (e.g. lateral side portion 68, the medial side portion 66, the heel portion 62, etc.) overly respective thermoformable portions of the liner 50 (e.g. the medial side portion 416, the lateral side portion 418, the heel portion 412, etc.).

Practically, as shown in FIG. 15, in this embodiment, the skate 10 having a specific size (e.g. 8.5D, 8.5DD, 8.5E, 9.0D, etc.) may be provided with the shell 30 and the liner 50. The skate 10, including the shell 30 and the liner 50, may then be heated to the pre-determined temperature (e.g., at least 45° C., at least 50° C., at least 55° C., at least 60° C., at least 65° C., at least 70° C., at least 75° C., at least 80° C., at least 85° C., at least 90° C., at least 100° C., at least 110° C.) at which it may expand and be tightly worn by the hockey goalkeeper 12 during a pre-determined time (e.g., at least 5 minutes, at least 10 minutes, at least 15 minutes, at least 20 minutes, at least 30 minutes), such that the original shape of the liner 50 is customably altered to conform to the goalie foot 11 and to fill the space between the cavity 54 defined by the shell 30 and the goalie foot 11 when the goalie wears the skate 10.

The liner 50 may comprise a compressible material to ensure a better fit of the skate 10 with the goalie foot 11 while increasing comfort. Specifically, the compressible material may be a thermoformable material such that the liner 50 can be heated to the pre-determined temperature at which the original shape of the liner 50 can be altered into its altered shape and the liner 50 can keep its altered shape after cooling down. More specifically, the compressible thermoformable material may be a thermoexpandable material such that the compressible material expands when the liner 50 is heated to the pre-determined temperature.

The pre-determined temperature of the compressible thermoformable thermoexpandable material of the liner 50 may have any suitable value compared to the predetermined temperature of the synthetic materials 72, 74 of the shell 30. For example, in some embodiments, the pre-determined temperature of the material of the liner 50 may be the same as the predetermined temperature of the synthetic materials 72, 74 of the shell 30, while in some embodiments the pre-determined temperature of the material of the liner 50 may be lower than the predetermined temperature of the synthetic materials 72, 74 of the shell 30 (e.g., by at least 5° C., by at least 10° C., by at least 20° C., by at least 30° C.), while in some embodiments the pre-determined temperature of the material of the liner 50 may be higher than the predetermined temperature of the synthetic materials 72, 74 of the shell 30 (e.g., by at least 5° C., by at least 10° C., by at least 20° C., by at least 30° C.).

In this embodiment, the liner 50 comprises a plurality of pieces that are affixed (e.g., stitched) to one another. In variants, however, the liner 50 may be a one-piece liner.

In this embodiment, the plurality of pieces of the liner 50 define a plurality of zones $\mathbf{70}_1$-$\mathbf{70}_z$ having different mechanical properties to increase comfort over pre-determined area of the goalie foot 11 and increase comfort over some areas of the goalie foot 11. Each one of the zones $\mathbf{70}_1$-$\mathbf{70}_z$ may comprise a respective one of materials $\mathbf{340}_1$-$\mathbf{340}_M$. The materials $\mathbf{340}_1$-$\mathbf{340}_M$ may differ from one zone to another, and the different materials $\mathbf{340}_1$-$\mathbf{340}_M$ may be connected and affixed to one another by being fastened to one another, e.g., by stitching. For instance, some of the materials $\mathbf{340}_1$-$\mathbf{340}_M$ may be compressible, thermoformable and/or thermoexpandable, while some of the materials $\mathbf{340}_1$-$\mathbf{340}_M$ may be non-thermoformable and/or non-thermoexpandable, such that some of the zones $\mathbf{70}_1$-$\mathbf{70}_z$ may be compressible, thermoformable and/or thermoexpandable, while some of the zones $\mathbf{70}_1$-$\mathbf{70}_z$ may be non-thermoformable and/or non-thermoexpandable.

Thermoformability (i.e., a degree of ease with which that portion can be thermoformed, higher thermoformability entailing that less energy is needed to achieve a given level of deformation or more deformation is achieved with a given level of energy) of the materials $\mathbf{340}_1$-$\mathbf{340}_M$ of each one of the zones $\mathbf{70}_1$-$\mathbf{70}_z$ may also be different. For instance, in some embodiments, thermoformabilities of the different materials $\mathbf{340}_1$-$\mathbf{340}_M$ of zones $\mathbf{70}_1$-$\mathbf{70}_z$ may vary. For example, thermoformabilities of respective ones of the materials $\mathbf{340}_1$-$\mathbf{340}_M$ of the respective ones of the zones $\mathbf{70}_1$-$\mathbf{70}_z$ corresponding to the medial side portion 416 and the lateral side portion 418 of the liner 50 may be greater than a thermoformability of the materials $\mathbf{340}_1$-$\mathbf{340}_M$ of the respective ones of the zones $\mathbf{70}_1$-$\mathbf{70}_z$ corresponding to the heel portion 412 of the liner 50.

Mechanical properties of the materials $\mathbf{340}_1$-$\mathbf{340}_M$ of each one of the zones $\mathbf{70}_1$-$\mathbf{70}_z$ may also be different. For instance, in some embodiments, rigidities of the respective compressible materials $\mathbf{340}_1$-$\mathbf{340}_M$ of zones $\mathbf{70}_1$-$\mathbf{70}_z$ may vary, and in some embodiments, a ratio of the rigidity (i.e., modulus of elasticity or Young's modulus) of the compressible material $\mathbf{340}_i$ of a given one of the zones $\mathbf{70}_1$-$\mathbf{70}_z$ (e.g., spanning at least part of the sole portion 420 for facing the plantar surface PS of the goalie 12 and/or the toe covering portion 422) over the rigidity of the compressible material $\mathbf{340}_j$ of another one of the zones $\mathbf{70}_1$-$\mathbf{70}_z$ (e.g., spanning at least part of the medial side portion 416 for facing the medial side MS of the goalie's foot 11, a lateral side portion 418, the heel portion 412, the ankle portion 414, and/or the tongue 34) is at least 2, in some embodiments at least 5, in some embodiments at least 10, in some embodiments at least 15, in some embodiments at least 17, and in some embodiments even more (e.g., at least 20). In some embodiments, a density of the compressible materials $\mathbf{340}_1$-$\mathbf{340}_M$ of zones $\mathbf{70}_1$-$\mathbf{70}_z$ may be different, and in some embodiments, a ratio of the density of the compressible material $\mathbf{340}_i$ of a given one of the zones $\mathbf{70}_1$-$\mathbf{70}_z$ (e.g., spanning at least part of the sole portion 420 for facing the plantar surface PS of the goalie 12 and/or the toe covering portion 422) over the density of the compressible material $\mathbf{340}_j$ of another one of the zones $\mathbf{70}_1$-$\mathbf{70}_z$ (e.g., spanning at least part of the medial side portion 416 for facing the medial side MS of the goalie's foot 11, a lateral side portion 418, the heel portion 412, the ankle portion 414, and/or the tongue 34) is at least 2, in some embodiments at least 5, in some embodiments at least 10, in some embodiments at least 15, in some embodiments at least 16, and in some embodiments even more (e.g., at least 20).

Any suitably material may be used in the liner 50. In this embodiment, the materials $\mathbf{340}_1$-$\mathbf{340}_M$ may be polymers. More specifically, the materials $\mathbf{340}_1$-$\mathbf{340}_M$ comprise polymeric foams. More specifically, the compressible materials $\mathbf{340}_1$-$\mathbf{340}_M$ may be closed cell chemically cross-linked foams which have relatively high levels of cross-linking (e.g. at least 70%, at least 75%, at least 80%) and may provide increased thermo-moulding and thermo-forming capabilities. During manufacturing, the materials $\mathbf{340}_1$-$\mathbf{340}_M$ may be pre-heated and placed in a cold mold under pressure, such that the materials $\mathbf{340}_1$-$\mathbf{340}_M$ have increased deformation capabilities. The materials $\mathbf{340}_1$-$\mathbf{340}_M$ of the liner 50 may include polyethylene foam, ethyl-vinyl-acetate copolymers, blended copolymers, vinyl-nitrile foam, Poron, Ultrastop.

The footbed 38 may be mounted inside the liner 50 and comprises an upper surface 106 for receiving the plantar surface PS of the goalie's foot 11 and a wall 108 projecting upwardly from the upper surface 106 to partially cup the heel HL and extend up to a medial line of the goalie's foot 11. The insole may have an upper surface 25 for facing the plantar surface PS of the goalie's foot 11 and a lower surface 23 facing a sole portion of the liner 50.

The outsole 42 is affixed to an underside of the shell 30 for forming the skate boot 22. The outsole 42 comprises a rigid material for imparting rigidity to the outsole 42. More particularly, in this embodiment, the rigid material of the outsole 42 comprises a composite material. For example, the composite material may be a fiber-matrix composite material that comprises a matrix in which fibers are embedded. The matrix may include any suitable polymeric resin, such as a thermosetting polymeric material (e.g., polyester, vinyl ester, vinyl ether, polyurethane, epoxy, cyanate ester, etc.), a thermoplastic polymeric material (e.g., polyethylene, polypropylene, acrylic resin, polyether ether ketone, polyethylene terephthalate, polyvinyl chloride, polymethyl methacrylate, polycarbonate, acrylonitrile butadiene styrene, nylon, polyimide, polysulfone, polyamide-imide, self-reinforcing polyphenylene, etc.), or a hybrid thermosetting-thermoplastic polymeric material. The fibers may be made of any suitable material such as carbon fibers, polymeric fibers such as aramid fibers, boron fibers, glass fibers, ceramic fibers, etc. In other embodiments, the rigid material may comprise any other suitable material (e.g., nylon, polycarbonate materials, polyurethane, thermoplastics, thermosetting resins, reinforced thermoplastics, reinforced thermosetting resins, polyethylene, polypropylene, high density polyethylene).

Figure 16:
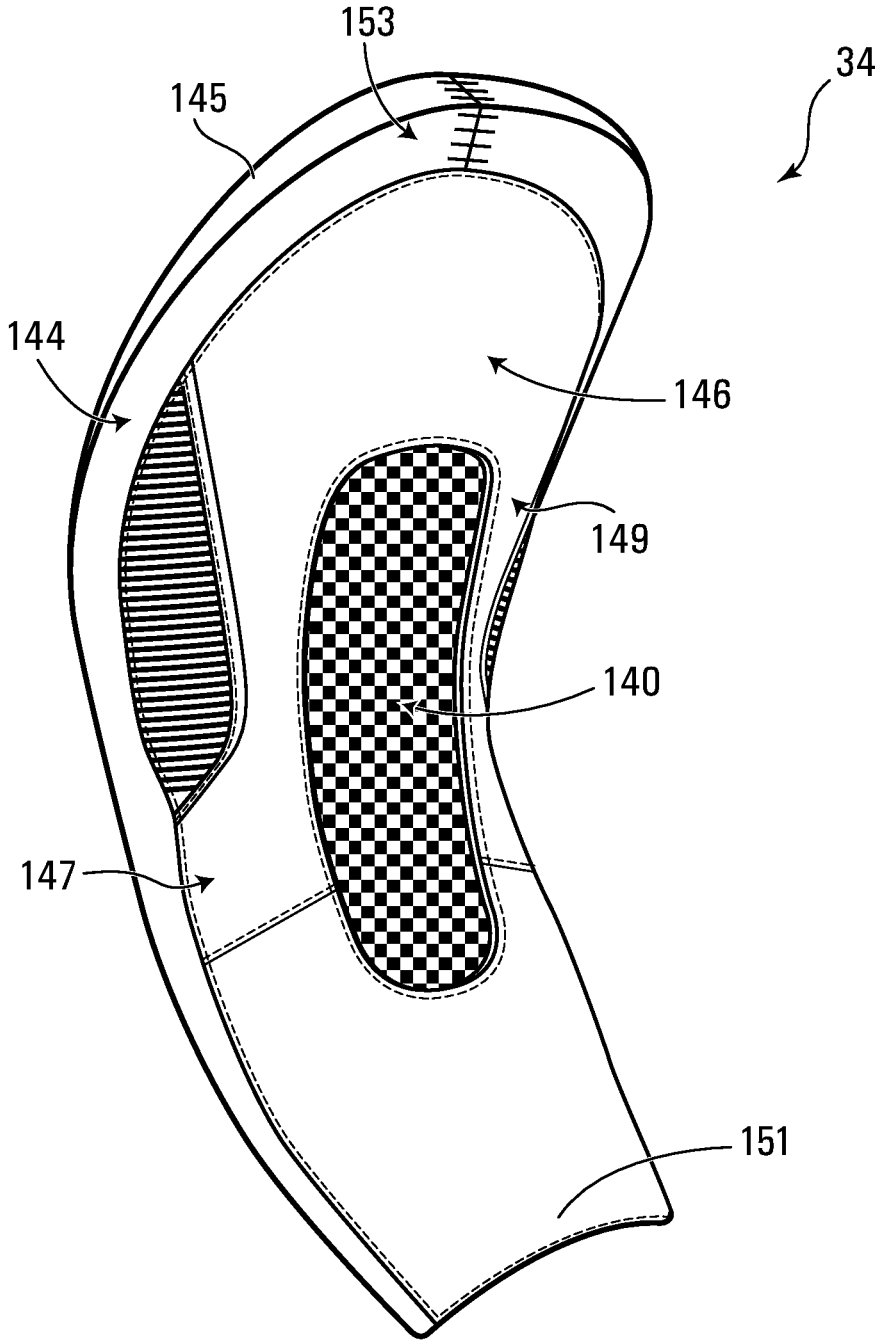
FIGS. 16 and 17 show a perspective view and an exploded of a tongue of the skate boot.
Figure 17:
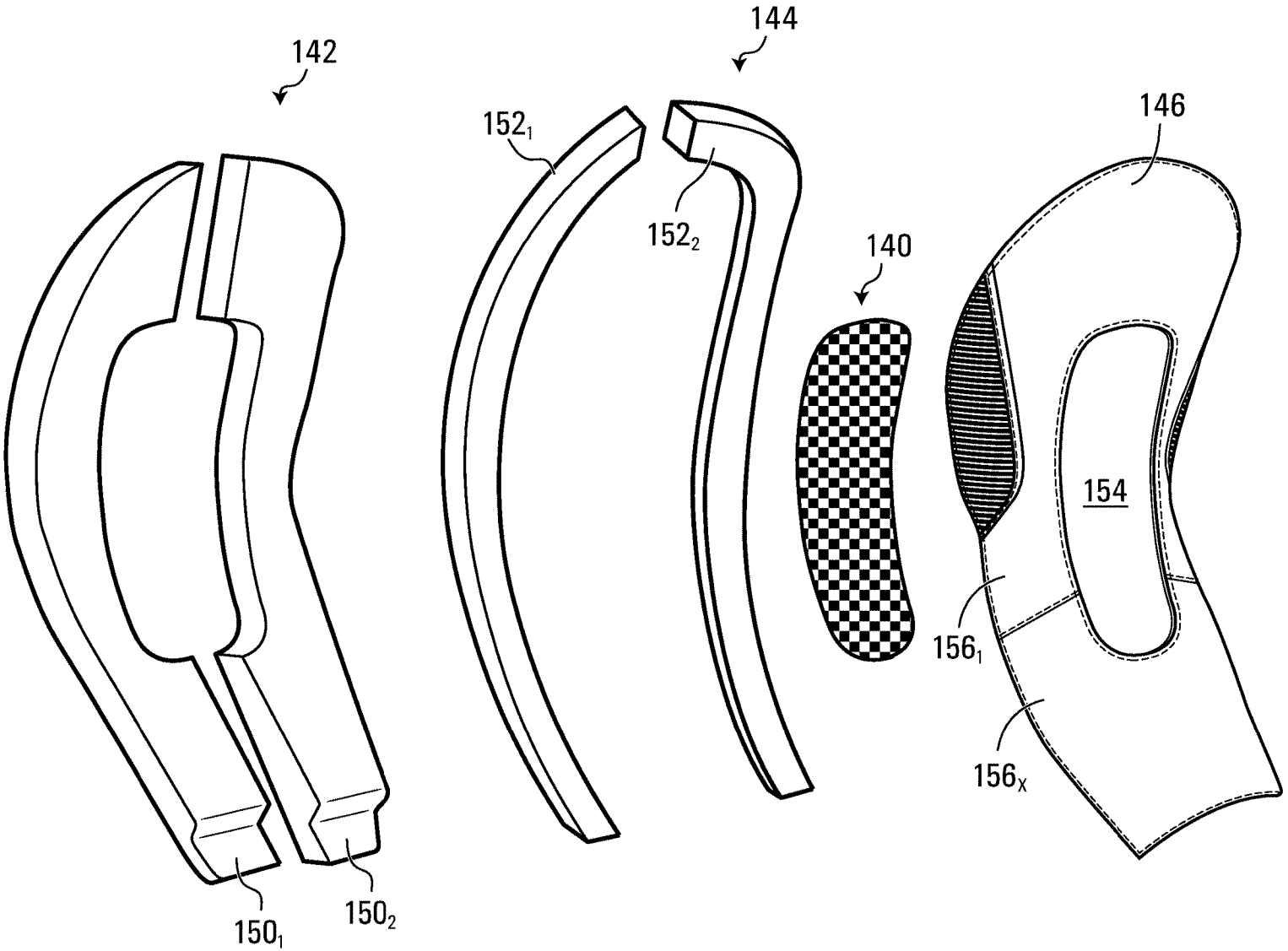

The tongue 34 extends upwardly and rearwardly from the toe-covering portion $\mathbf{42}_2$ of the liner 50 for overlapping the top surface TS of the goalie's foot 11. In this embodiment, with additional reference to FIGS. 16 and 17, the tongue 34 comprises a core 140 defining a section of the tongue 34 with increased rigidity, a padding member 142 for absorbing impacts to the tongue 34, a peripheral member 144 for at least partially defining a periphery 145 of the tongue 34, and a cover member 146 configured to at least partially define a front surface of the tongue 34. The tongue 34 defines a lateral portion 147 overlying a lateral portion of the goalie's foot 11 and a medial portion 149 overlying a medial portion of the goalie's foot 11.

The core 140 comprises one or more materials suitable for providing additional rigidity to the tongue 34. For instance, in this embodiment, the core 140 comprises a padding reinforced with a rigid insert. The rigid insert of the core 140 may comprise any suitable material to provide additional rigidity to the tongue 34. For example, the rigid insert may comprise a plastic material (e.g., nylon) and/or a composite material (e.g., carbon fiber). The rigid insert may comprise any other suitable material in other embodiments.

The padding member 142 is configured to surround the core 140 and is affixed thereto (e.g., via stitching). The padding member 142 comprises a material 148 suitable for absorbing impacts. For instance, in this embodiment, the material 148 comprises felt. In other embodiments, the material 148 of the padding member 142 may comprise a foam material, a fibrous material, a non-woven material, a laminate material (e.g., foam "sandwiched" between layers of textile) or any other suitable material. The material 148 of the padding member 142 may be one of a plurality of materials of the padding member 142. For example, in some cases, the padding member 142 may comprise an additional material (e.g., foam) that is layered on top of the material 148. Moreover, in this embodiment, the padding member 142 comprises a pair of padding elements $\mathbf{150}_1$, $\mathbf{150}_2$ that are affixed to one another to form the padding member 142. In this example, the padding elements $\mathbf{150}_1$, $\mathbf{150}_2$ are lateral and medial padding elements $\mathbf{150}_1$, $\mathbf{150}_2$.

The peripheral member 144 is affixed to the padding member 142 such as to define the periphery of the tongue 34. In this embodiment, the peripheral member 144 comprises a pair of peripheral elements $\mathbf{152}_1$, $\mathbf{152}_2$ that are affixed to one another, and to the padding member 142, to form the peripheral member 144. More particularly, in this embodiment, the peripheral elements $\mathbf{152}_1$, $\mathbf{152}_2$ are lateral and medial peripheral elements $\mathbf{152}_1$, $\mathbf{152}_2$.

The cover member 146 constitutes an esthetic appearance of the front surface of the tongue 32. As such, the cover member 146 may comprise a variety of decorative features such as a textured surface (e.g., ridges, grooves, etc.), a trademark or logo stitched thereto or a section defining a different color. In some embodiments, the decorative features such as the logo may be printed or formed (e.g., embossed) on the cover member 146. In this embodiment, the cover member 146 comprises a plurality of cover elements $\mathbf{156}_1$-$\mathbf{156}_x$ that are affixed to one another (e.g., via stitching or gluing) in order to form the cover member 146. Moreover, in its assembled state, the cover member 146 defines an opening 154 for exposing the core 140.

In this embodiment, the tongue 34 is configured to be asymmetric. More particularly, the lateral and medial portions 147, 149 of the tongue 34 extend to different heights such that the proximal portion 153 of the tongue 34 is uneven in the height-wise direction of the skate 10. Specifically, the medial portion 149 of the tongue 34 extends higher than the lateral portion 149 of the tongue 34. To that end, the lateral and medial padding elements $\mathbf{150}_1$, $\mathbf{150}_2$ are shaped differently from one another and the lateral and medial peripheral elements $\mathbf{152}_1$, $\mathbf{152}_2$ are shaped differently from one another. Moreover, the cover member 146 is also configured such that its lateral portion is shaped differently from its medial portion. This asymmetric design of the tongue 34 may provide additional padding at a pressure point of the tongue 34 and may minimize interference with the goalie's leg (e.g., in butterfly style).

The skate boot 22 may be constructed in any other suitable way in other embodiments. For example, in other embodiments, various components of the skate boot 22 mentioned above may be configured differently or omitted and/or the skate boot 22 may comprise any other components that may be made of any other suitable materials and/or using any other suitable processes.

Figure 18:
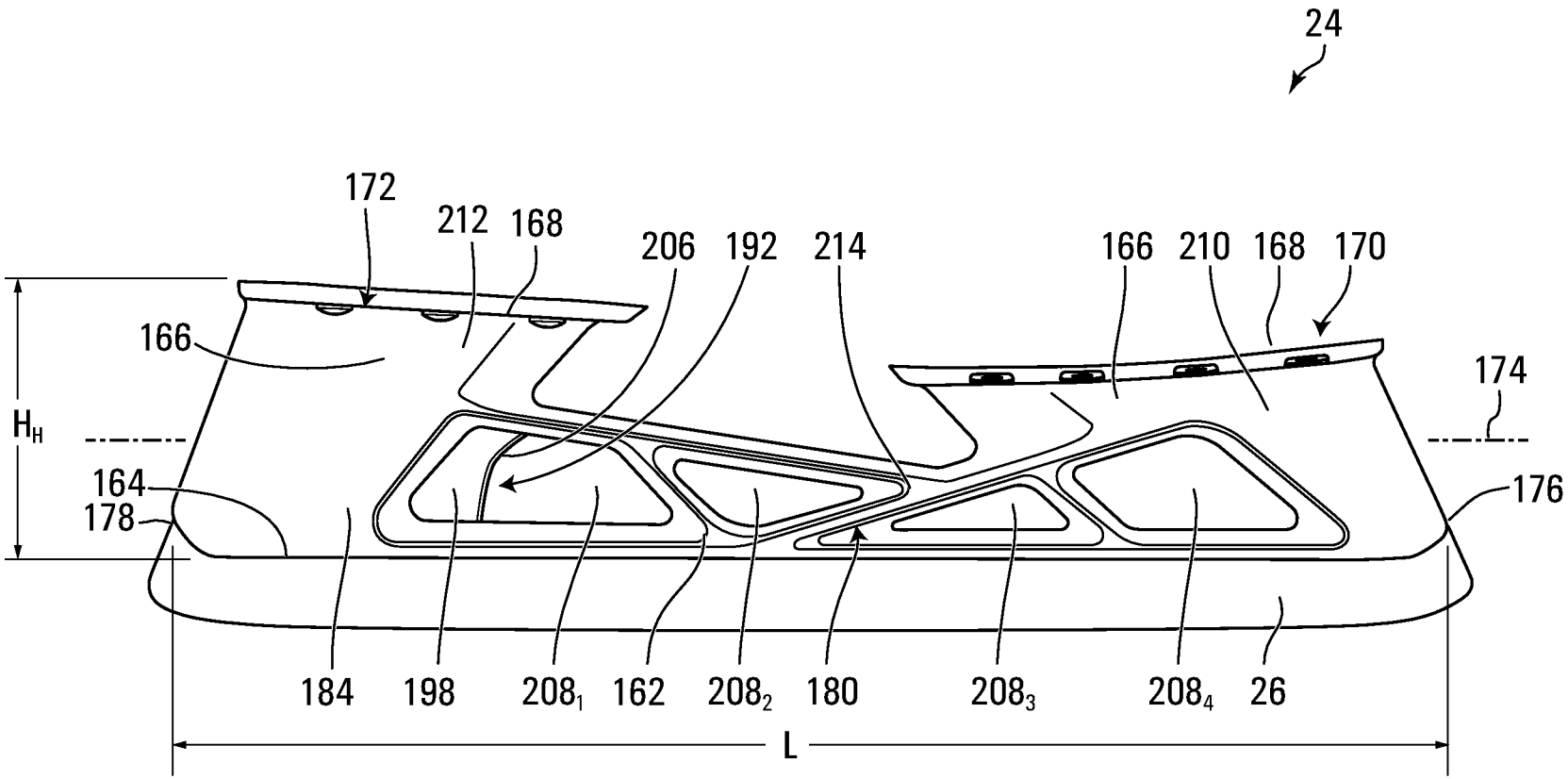
FIG. 18 shows a blade and a blade holder of the goalie skate.
Figure 19:
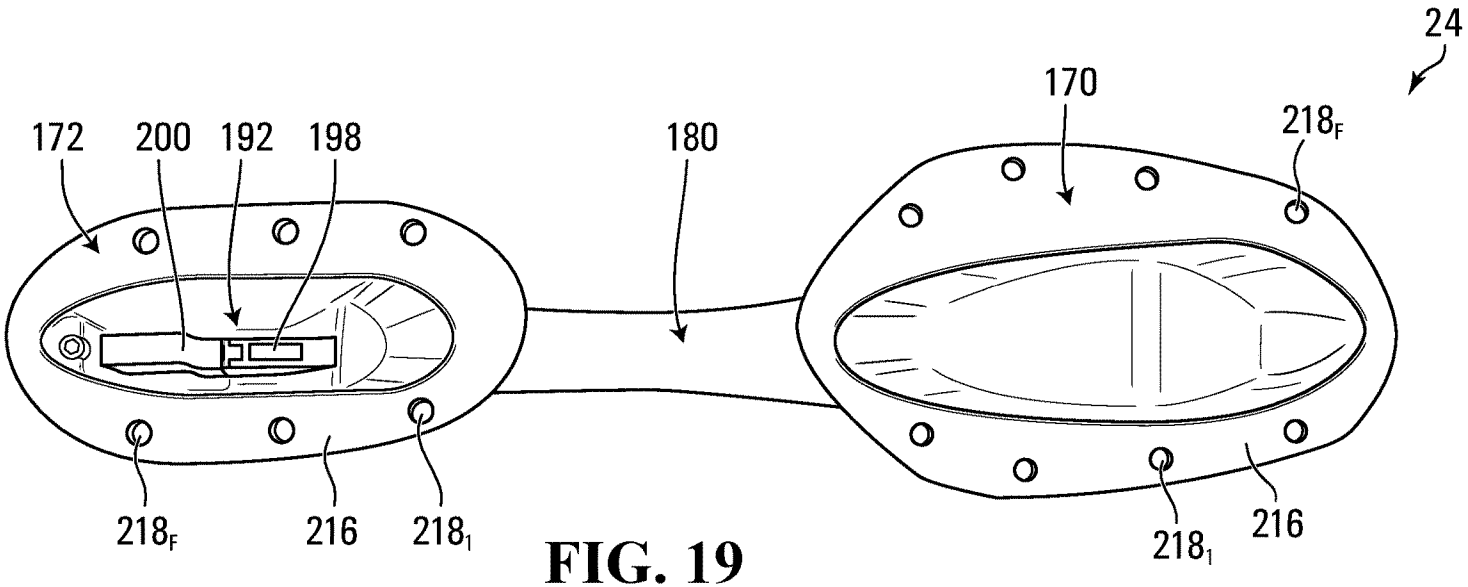
FIGS. 19 and 20 show a top view and a bottom view of the blade holder, including a blade-detachment mechanism.
Figure 20:
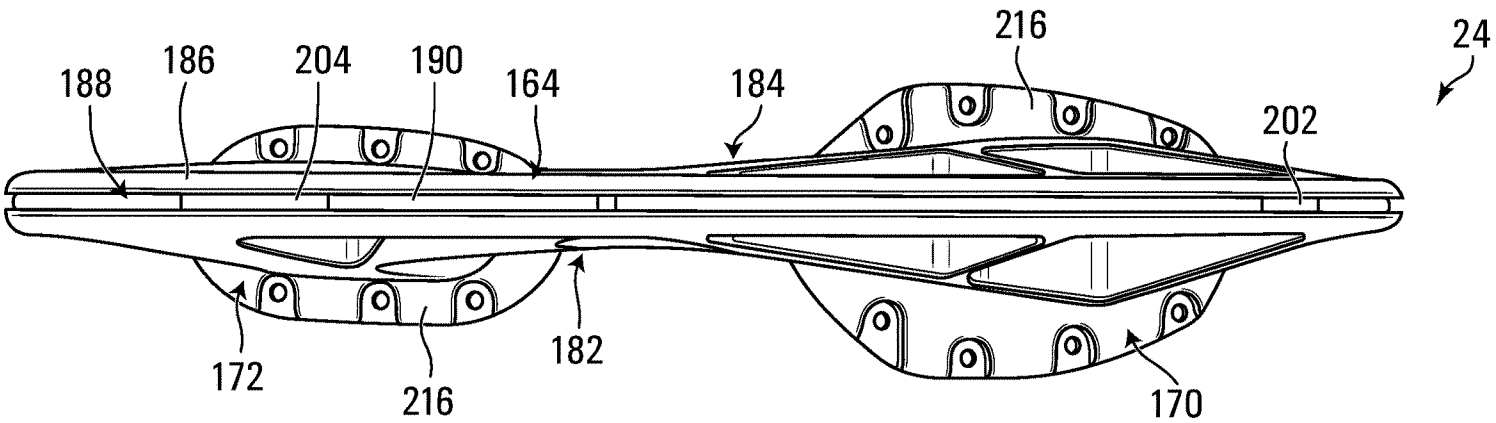

With additional reference to FIGS. 18 to 20, the blade holder 24 comprises a lower portion 162 comprising a blade-retaining base 164 that retains the blade 26 and an upper portion 166 comprising a support 168 that extends upwardly from the blade-retaining base 164 towards the skate boot 22 to interconnect the blade holder 24 and the skate boot 22. A front portion 170 of the blade holder 24 and a rear portion 172 of the blade holder 24 define a longitudinal axis 174 of the blade holder 24. The front portion 170 of the blade holder 24 includes a frontmost point 176 of the blade holder 24 and extends beneath and along the skater's forefoot in use, while the rear portion 172 of the blade holder 24 includes a rearmost point 178 of the blade holder 24 and extends beneath and along the skater's hindfoot in use. An intermediate portion 180 of the blade holder 24 is between the front and rear portion 170, 172 of the blade holder 24 and extends beneath and along the skater's midfoot in use. A length L of the blade holder 24 can be measured from the frontmost point 176 to the rearmost point 178. The blade holder 24 comprises a medial side 182 and a lateral side 184 that are opposite one another. The blade holder 24 has a longitudinal direction (i.e., a direction generally parallel to its longitudinal axis 174) and transversal directions (i.e., directions transverse to its longitudinal axis 174), including a widthwise direction (i.e., a lateral direction generally perpendicular to its longitudinal axis 174). The blade holder 24 also has a height direction normal to its longitudinal and widthwise directions.

The blade-retaining base 164 is elongated in the longitudinal direction of the blade holder 24 and is configured to retain the blade 26 such that the blade 26 extends along a bottom portion 186 of the blade-retaining base 164 to contact the ice surface. To that end, the blade-retaining base 164 comprises a blade-retention portion 188 to face and retain the blade 26. In this embodiment, the blade-retention portion 188 comprises a recess 190 in which an upper portion of the blade 26 is disposed.

The blade holder 24 can retain the blade 26 in any suitable way. In this embodiment, the blade holder 24 comprises a blade-detachment mechanism 192 such that the blade 26 is selectively detachable and removable from, and attachable to, the blade holder 24 (e.g., when the blade 26 is worn out or otherwise needs to be replaced or removed from the blade holder 24). More particularly, in this embodiment, the blade 26 includes a plurality of projections 194, 196. The blade-detachment mechanism 192 includes an actuator 198 and a biasing element 200 which biases the actuator 198 in a direction towards the front portion 170 of the blade holder 24. In this embodiment, the actuator 198 comprises a trigger. To attach the blade 26 to the blade holder 24, the front projection 194 is first positioned within a hollow space 202 (e.g., a recess or hole) of the blade holder 24. The rear projection 196 can then be pushed upwardly into a hollow space 204 (e.g., a recess or hole) of the blade holder 24, thereby causing the biasing element 200 to bend and the actuator 198 to move in a rearward direction. The rear projection 196 will eventually reach a position which will allow the biasing element 200 to force the actuator 198 towards the front portion 170 of the blade holder 24, thereby locking the blade 26 in place. The blade 26 can then be removed by pushing against a finger-actuating surface 206 of the actuator 198 to release the rear projection 196 from the hollow space 204 of the blade holder 24. Thus, in this embodiment, the blade-detachment mechanism 192 is free of any threaded fastener (e.g., a screw or bolt) to be manipulated to detach and remove the blade 26 from the blade holder 24 or to attach the blade 26 to the blade holder 24. Further information on examples of implementation of the blade-detachment mechanism 192 in some embodiments may be obtained from U.S. Pat. No. 8,454,030 hereby incorporated by reference herein. The blade-detachment mechanism 192 may be configured in any other suitable way in other embodiments.

In this embodiment, the blade-retaining base 164 comprises a plurality of apertures 2081-2084 distributed in the longitudinal direction of the blade holder 24 and extending from the medial side 182 to the lateral side 184 of the blade holder 24. In this example, respective ones of the apertures 2081-2084 differ in size. The apertures 2081-2084 may have any other suitable configuration, or may be omitted, in other embodiments.

The blade-retaining base 164 may be configured in any other suitable way in other embodiments.

The support 168 is configured for supporting the skate boot 22 above the blade-retaining base 164 and transmit forces to and from the blade-retaining base 164 during skating. In this embodiment, the support 168 comprises a front pillar 210 and a rear pillar 212 which extend upwardly from the blade-retaining base 164 towards the skate boot 22. The front pillar 210 extends towards the front portion of the skate boot 22 and the rear pillar 212 extends towards the rear portion 58 of the skate boot 22. The blade-retaining base 164 extends from the front pillar 210 to the rear pillar 212. More particularly, in this embodiment, the blade-retaining base 164 comprises a bridge 214 interconnecting the front and rear pillars 84, 86

The support 168 and the skate boot 22 can be connected to one another (i.e., in opposition to being integrally formed with one another) in any suitable way. In this embodiment, the support 168 is affixed to the skate boot 22. More particularly, in this embodiment, the front and rear pillars 210, 212 are fastened to the skate boot 22 by fasteners (e.g., rivets, screws, bolts). In this example, each of the front and rear pillars 210, 212 comprises a flange 216 including a plurality of apertures 2181-218F to receive respective ones of the fasteners that fasten the blade holder 24 to the skate boot 22. The support 168 may be affixed to the skate boot 22 in any other suitable manner in other embodiments (e.g., by an adhesive).

Figure 21:
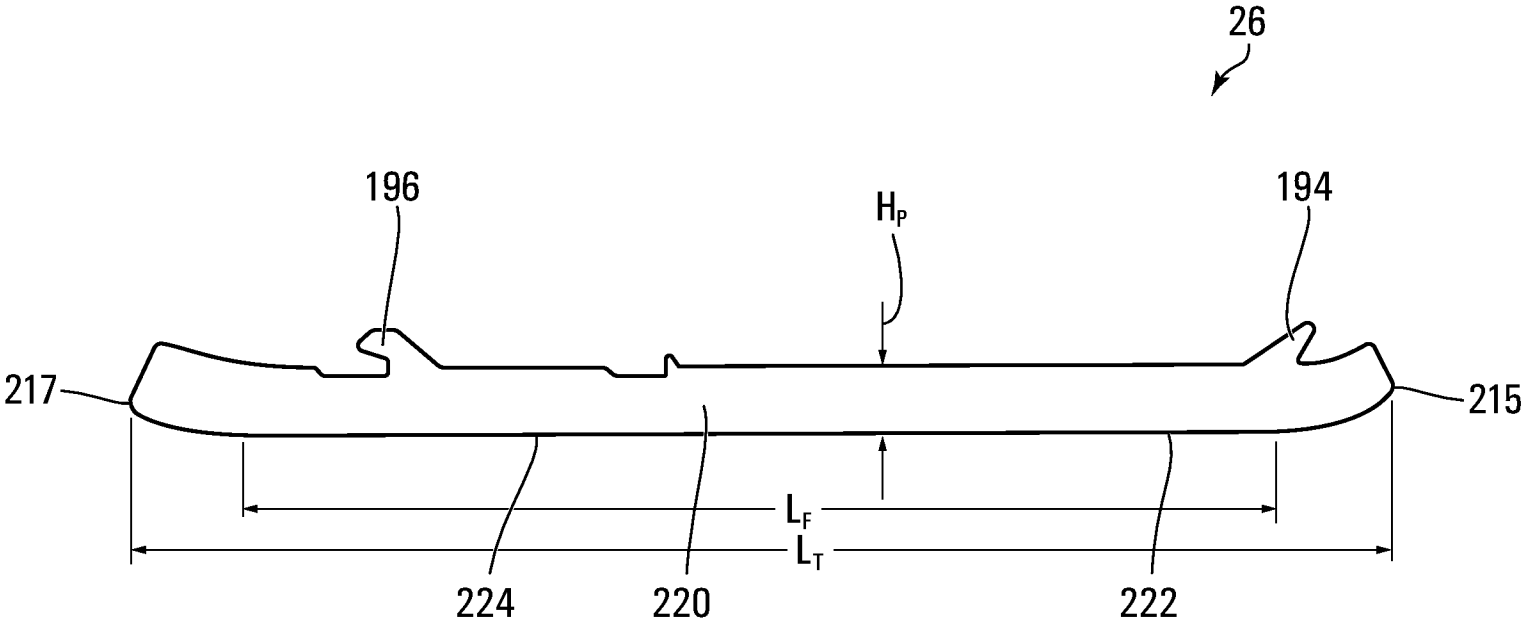
FIG. 21 shows a side view of the blade.

With additional reference to FIG. 21, the blade 26 comprises an ice-contacting material 220 including an ice-contacting surface 222 for sliding on the ice surface while the goalie 12 skates. In this embodiment, the ice-contacting material 220 is a metallic material (e.g., stainless steel). The ice-contacting material 220 may be any other suitable material in other embodiments. Also, in this embodiment, an entirety of the blade 26 is made of the ice-contacting material 220. The blade 26 has a length LT measured from a frontmost point 215 to a rearmost point 217 of the blade 26.

The ice-contacting surface 222 of the blade 26 comprises a flat portion 224 having a length LF. The portion of the ice-contacting surface 222 that is not part of the flat portion 215 (i.e., on either side of the flat portion 125) diverges from the ice (e.g., is generally curved away from the ice). The length LF of the flat portion 224 is significant relative to the length $L_T$ of the blade 26 as opposed to that of blades of other skates for hockey players other than goalies (i.e., forwards and defensemen). For instance, a ratio $L_F/L_T$ of the length $L_F$ of the flat portion 224 of the blade over the length $L_T$ of the blade 26 may be at least 0.6, in some cases at least 0.65, in some cases at least 0.7, in some cases at least 0.75, in some cases at least 0.8, in some cases at least 0.85, and in some cases even more.

The blade 26 also has a width that is significant relative to a width of blades of other skates for hockey players other than goalies. For example, the width of the blade 26 may be at least 3 mm, in some cases at least 4 mm, in some cases at least 5 mm, and in some cases even more.

The blade holder 24 and the blade 26 may be designed to complementarily decrease a weight of the skate 10 while simultaneously increasing its support height $H_S$. For instance, in this embodiment, the blade holder 24 has a relatively large height $H_H$. That is, the height $H_H$ of the blade holder 24 is significant in comparison to the blade holder of conventional goalie skates. For example, a ratio $H_H/H_S$ of the height $H_H$ of the blade holder 24 over the support height $H_S$ of the skate 10 may be at least 0.7, in some cases at least 0.75, in some cases at least 0.8, in some cases at least 0.85, in some cases at least 0.9, and in some cases even more.

Simultaneously, the blade 26 may have a relatively small height Hp. That is, in this embodiment, the height Hp of the blade 26 is small in comparison to the blade of conventional goalie skates. For example, a ratio $H_P/H_S$ of the height Hp of the blade 26 over the support height $H_S$ of the skate 10 may be at least 0.15, in some cases at least 0.2, in some cases at least 0.25, in some cases at least 0.3 and in some cases even more. Moreover, a ratio $H_H/H_P$ of the height $H_H$ of the blade holder 24 over the height Hp of the blade 26 may be at least 3, in some cases at least 3.5, in some cases at least 4, and in some cases even more.

As the blade 26 is typically denser than the blade holder 24, the increased height of the blade holder 24 and the decreased height of the blade 26 may cause a reduction in the weight of the skate 10. Moreover, the resulting increased support height $H_S$ also may also allow an increase in the maximum angle of attack $\theta_A$ of the skate 10.

The goalie skate 10 may be implemented in any other suitable way in other embodiments.

For instance, in a variant, the skate boot 22 may not comprise any lace members and the eyelets $\mathbf{46}_1$-$\mathbf{46}_E$ may extend directly through the shell 30 and the liner 50 via the apertures 48. The skate boot 22 may be free of a toe cap, such that an external surface of the toe covering portion 32 of the shell 30 may define a frontmost surface of the skate boot and define an external profile of a toe area 31 of the skate boot 22.

Figure 22:
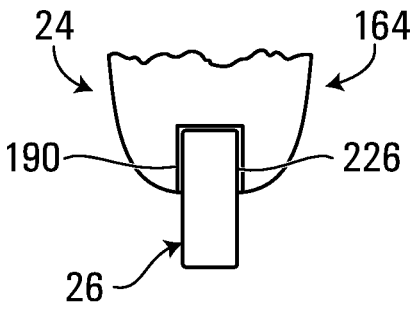
FIGS. 22 to 25 show variants in which the blade is permanently affixed to the blade holder.
Figure 23:
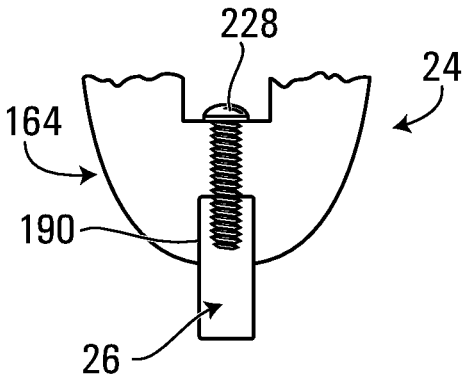
Figure 24:
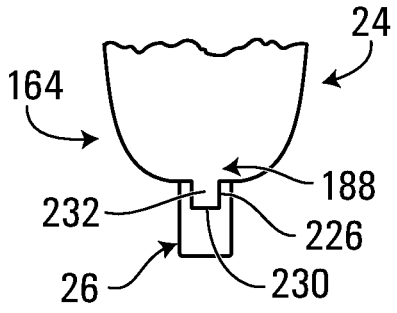
Figure 25:
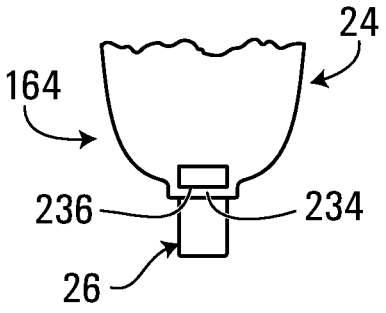

For instance, in a variant, the blade holder 24 may retain the blade 26 in any other suitable way. For instance, instead of being selectively detachable and removable from and attachable to the blade holder 24, in other embodiments, the blade 26 may be permanently affixed to the blade holder 24 (i.e., not intended to be detached and removed from the blade holder 24). As an example, in some embodiments, as shown in FIGS. 22 and 23, the blade holder 24 may retain the blade 26 using an adhesive 226 and/or one or more fasteners 228. For instance, in some embodiments, as shown in FIG. 22, the recess 190 of the blade holder 24 may receive the upper part of the blade 26 that is retained by the adhesive 226. The adhesive 226 may be an epoxy-based adhesive, a polyurethane-based adhesive, or any suitable adhesive. In some embodiments, instead of or in addition to using an adhesive, as shown in FIG. 23, the recess 190 of the blade holder 24 may receive the upper part of the blade 26 that is retained by the one or more fasteners 228. Each fastener 228 may be a rivet, a screw, a bolt, or any other suitable mechanical fastener. Alternatively or additionally, in some embodiments, as shown in FIG. 24, the blade-retention portion 188 of the blade holder 24 may extend into a recess 230 of the upper part of the blade 26 to retain the blade 26 using the adhesive 226 and/or the one or more fasteners 228. For instance, in some cases, the blade-retention portion 188 of the blade holder 24 may comprise a projection 232 extending into the recess 230 of the blade 26. As another example, in some embodiments, as shown in FIG. 25, the blade 26 and the blade-retaining base 164 of the blade holder 24 may be mechanically interlocked via an interlocking portion 234 of one of the blade-retaining base 164 and the blade 26 that extends into an interlocking void 236 of the other one of the blade-retaining base 164 and the blade 26. For instance, in some cases, the blade 26 can be positioned in a mold used for molding the blade holder 24 such that, during molding, the interlocking portion 234 of the blade-retaining base 164 flows into the interlocking void 236 of the blade 26 (i.e., the blade holder 24 is overmolded onto the blade 26).

Figure 26:
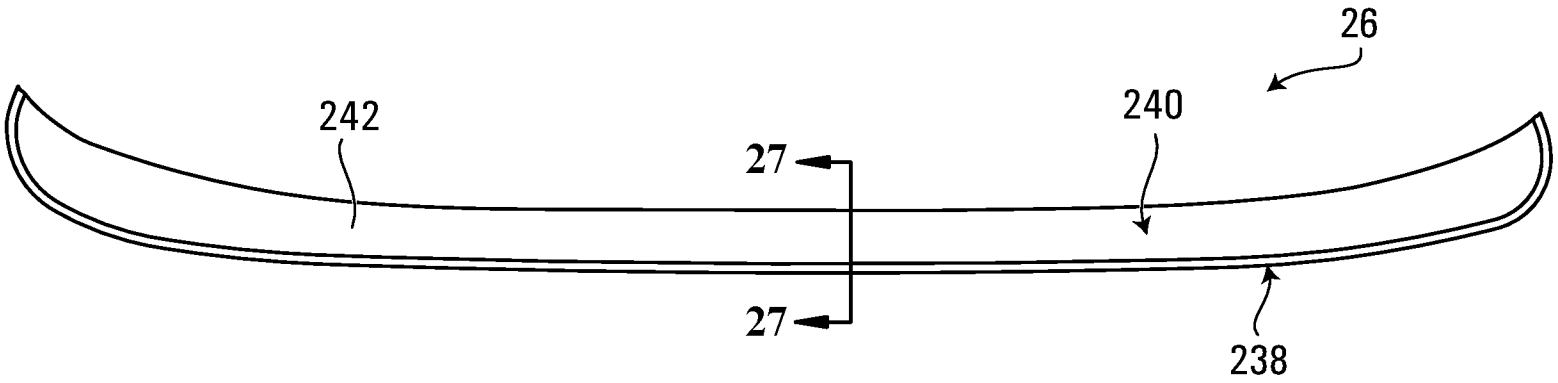
FIGS. 26 and 27 show a side view and front view of the blade in accordance with a variant in which in the blade comprises a runner and a body.
Figure 27:
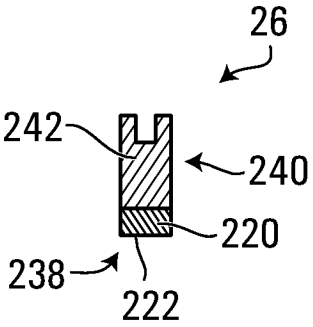
Figure 28:
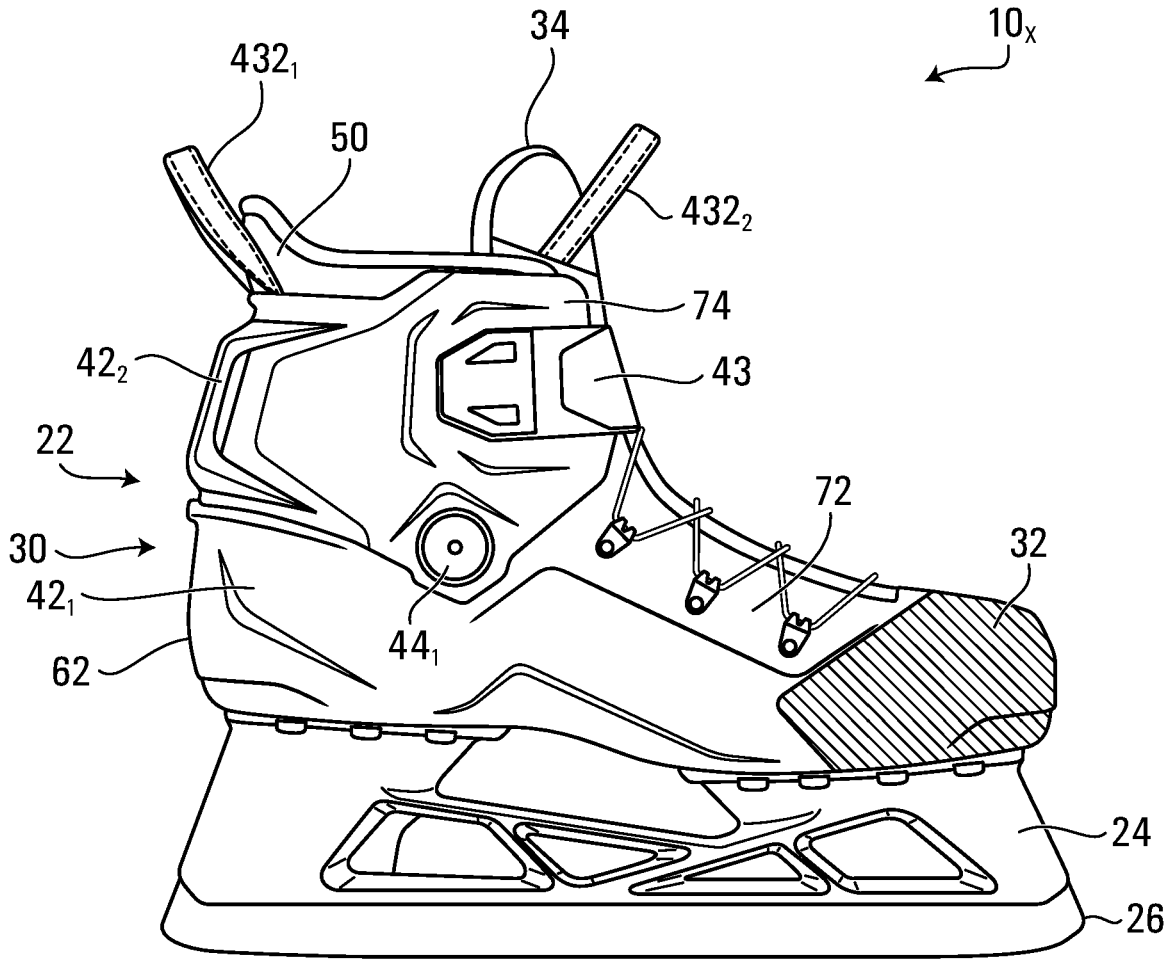
FIG. 28 shows a side view of a variant wherein the skate boot comprises a toe cap.
Figure 29:
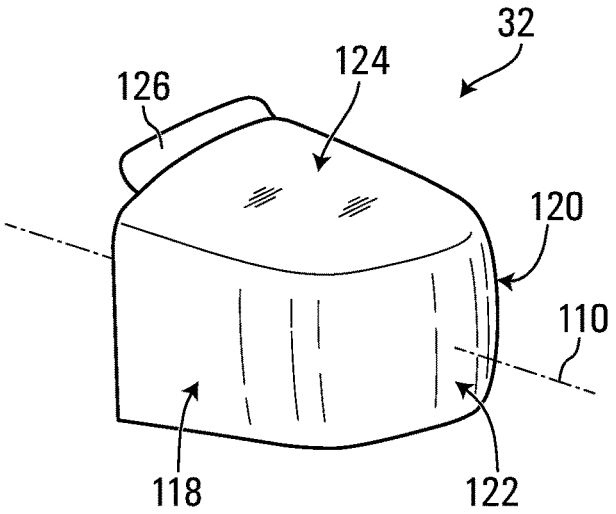
FIGS. 29 and 30 show perspective views of the toe cap.
Figure 30:
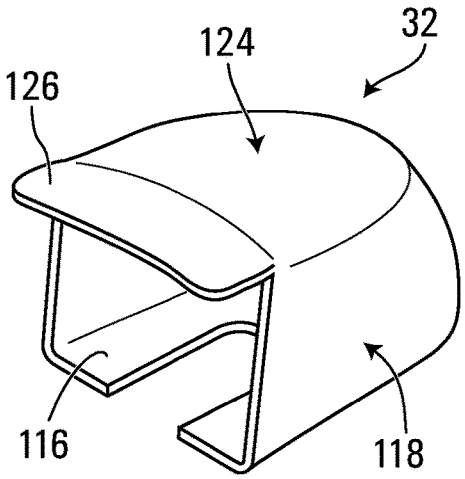
Figure 31:
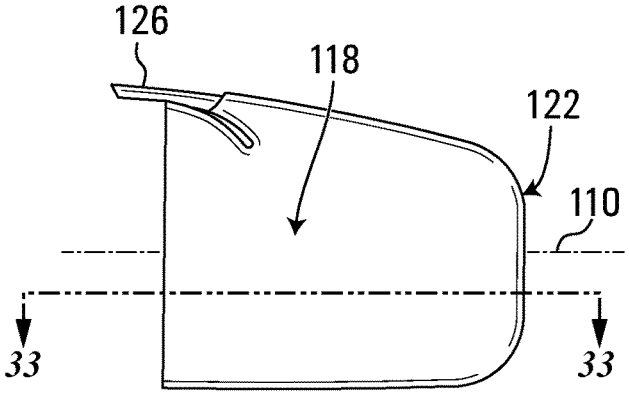
FIG. 31 shows a side view of the toe cap.
Figure 32:
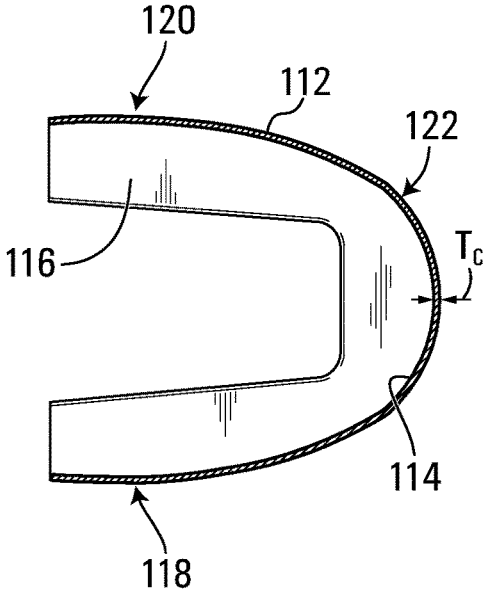
FIG. 32 shows a cross-sectional view of the toe cap taken along line 32-32 as indicated in FIG. 31.
Figure 33:
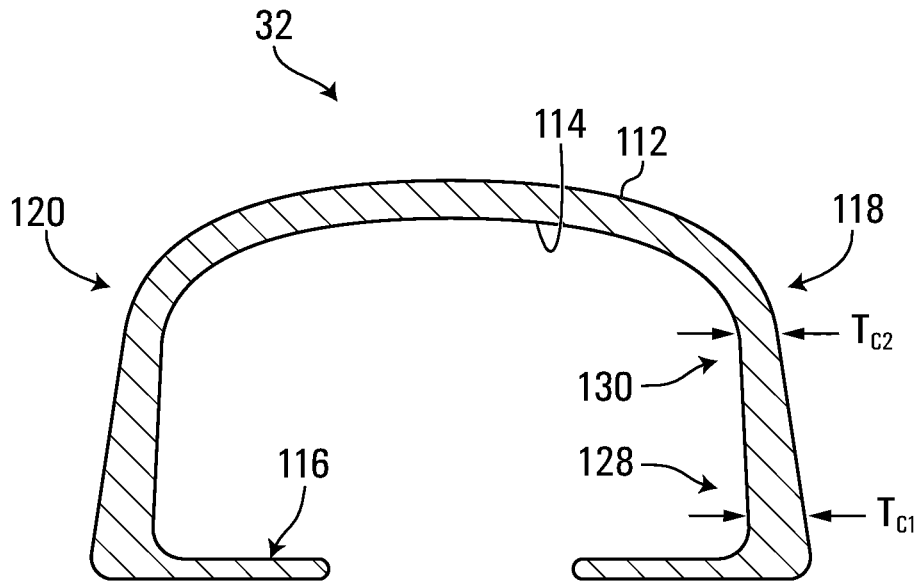
FIG. 33 shows a cross-sectional view of the toe cap where the toe cap comprises areas of increased thickness.
Figure 34:
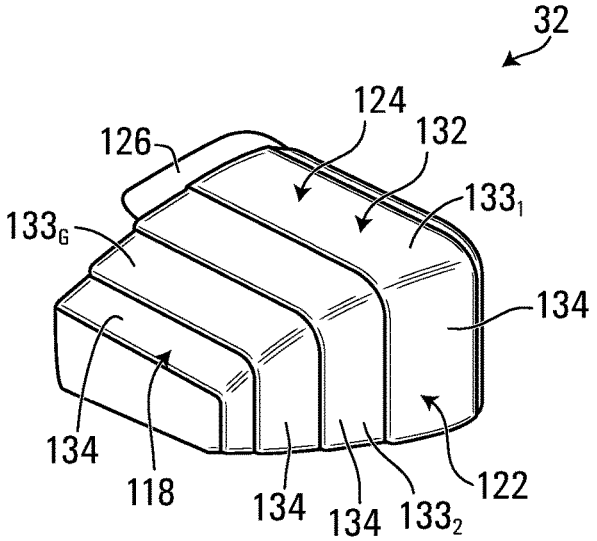
FIGS. 34 to 36 show a reinforcement of the toe cap in accordance with various embodiments.

The blade 26 may be implemented in any other suitable way in other embodiments. For example, in some embodiments, as shown in FIGS. 26 and 27, the blade 26 may comprise a runner 238 that is made of the ice-contacting material 220 and includes the ice-contacting surface 222 and a body 240 connected to the runner 238 and made of a material 242 different from the ice-contacting material 220. The runner 238 and the body 240 of the blade 26 may be retained together in any suitable way. For example, in some cases, the runner 238 may be adhesively bonded to the body 240 using an adhesive. As another example, in addition to or instead of being adhesively bonded, the runner 238 and the body 240 may be fastened using one or more fasteners (e.g., rivets, screws, bolts, etc.). As yet another example, the runner 238 and the body 240 may be mechanically interlocked by an interlocking portion of one of the runner 238 and the body 240 that extends into an interlocking space (e.g., one or more holes, one or more recesses, and/or one or more other hollow areas) of the other one of the runner 238 and the body 240 (e.g., the body 240 may be overmolded onto the runner 238).

In another variant, as shown in FIGS. 28 to 34, the skate boot 22 may comprise a toe cap 32 for covering and protecting the toes T of the goalie 12. The toe cap 32 may be configured to face and protect the toes T of the goalie's foot 11. In this example, the toe cap 32 is affixed to the inner surface of the shell 30 at the medial and lateral side portions 66, 68 of the shell 30 and extends along a longitudinal axis 110. The toe cap 32 comprises an outer surface 112 and an inner surface 114 opposite the outer surface 112. A thickness $T_C$ of the toe cap 32 is measured between the outer and inner surfaces 112, 114 of the toe cap 32. The top cap 32 comprises a bottom portion 116 for at least partially covering a front portion of the lower surface 23 of the insole, a lateral side portion 118 for facing a small toe of the foot 11 of the goalie 12, a medial side portion 120 for facing a big toe of the foot 11 of the goalie 12, an end portion 122 between the lateral and medial side portions 118, 120, an upper portion 124 for facing a top of the toes T of the goalie's foot 11, and a top extension 126 for affixing the tongue 34 to the toe cap 32. The top extension 126 of the toe cap 32 may be affixed (e.g., glued and/or stitched) to a distal end portion of the tongue 34 in order to affix the tongue 34 to the toe cap 32.

The toe cap 32 may comprise a synthetic material 105 that imparts stiffness to the toe cap 32. For instance, in various embodiments, the synthetic material 105 of the toe cap 32 may comprise nylon, polycarbonate materials (e.g., Lexan®), polyurethane, thermoplastics, thermosetting resins, reinforced thermoplastics, reinforced thermosetting resins, polyethylene, polypropylene, high density polyethylene or any other suitable material. In some cases, the synthetic material 105 of the toe cap 140 may be a composite material comprising thermoset material, thermoplastic material, carbon fibers and/or fiberglass fibers. For example, the composite material may be a fiber-matrix composite material that comprises a matrix in which fibers are embedded. The matrix may include any suitable polymeric resin, such as a thermosetting polymeric material (e.g., polyester, vinyl ester, vinyl ether, polyurethane, epoxy, cyanate ester, etc.), a thermoplastic polymeric material (e.g., polyethylene, polyurethane, polypropylene, acrylic resin, polyether ether ketone, polyethylene terephthalate, polyvinyl chloride, polymethyl methacrylate, polycarbonate, acrylonitrile butadiene styrene, nylon, polyimide, polysulfone, polyamide-imide, self-reinforcing polyphenylene, etc.), or a hybrid thermosetting-thermoplastic polymeric material. The fibers may be made of any suitable material such as carbon fibers, polymeric fibers such as aramid fibers, boron fibers, glass fibers, ceramic fibers, etc.

The synthetic material 105 of the toe cap 32 may be relatively stiff. For example, a stiffness of the synthetic material 105 of the toe cap 32 may be related to a modulus of elasticity (i.e., Young's modulus) of the synthetic material 105. For example, in this embodiment, the modulus of the synthetic material 105 of the toe cap 32 may be at least 0.5 GPa, in some cases at least 2 GPa, in some cases at least 3 GPa, in some cases at least 4 GPa, and in some cases even more.

The modulus of elasticity of the synthetic material 105 of the toe cap 32 may have any other suitable value in other embodiments.

As the skate 10 is cowlingless, in this embodiment, the toe cap 32 is reinforced. That is, in view of an absence of a cowling in the skate 10, the toe cap 32 is reinforced to properly protect the goalie's toes. The toe cap 32 is thus strengthened to take into account the absence of a cowling in the skate 10. For instance, the toe cap 32 may have a material composition (e.g., a stronger material or an additional material) and/or a shape (e.g., a thicker area) that makes the toe cap 32 more protective.

In this embodiment, the toe cap 32 is reinforced via an increase of a thickness $T_C$ of the toe cap 32. For instance, the thickness $T_C$ of the toe cap 32 may be greater than that of a toe cap 532 of the conventional goalie skate 510. For example, in some embodiments, the thickness $T_C$ of the toe cap 32 may be at least 5 mm, in some cases at least 6 mm, in some cases at least 7 mm, and in some cases even more. The thickness $T_C$ of the toe cap 32 may have any other suitable value in other embodiments.

Also, in this embodiment, the toe cap 32 comprises a reinforcement 132. In this example, the reinforcement 132 is disposed on the outer surface 112 of the toe cap 32. The reinforcement 132 may be provided on one or more of the lateral side portion 118, the medial side portion 120, the end portion 122 and the upper portion 124 of the toe cap 32.

In this example, the reinforcement 132 comprises a plurality of reinforcing elements $\mathbf{133}_1$-$\mathbf{133}_G$ distributed on the toe cap 32. More particularly, in this embodiment, each of the reinforcements $\mathbf{133}_1$-$\mathbf{133}_G$ extends along a front-to-rear direction of the toe cap 32 (i.e., generally along a direction of the longitudinal axis 110). In other embodiments, the reinforcements $\mathbf{133}_1$-$\mathbf{133}_G$ may extend in any other direction (e.g., a direction transversal to the longitudinal axis 110). In this case, each of the reinforcements $\mathbf{133}_1$-$\mathbf{133}_G$ comprises a projection 134 projecting on the outer surface 112 of the toe cap 132. For example, the projection 134 may be a rib, a ridge, or any other suitable projection. The reinforcements $133_1$-$133_G$ may form corrugations on the outer surface 112 of the toe cap 32.

Figure 35:
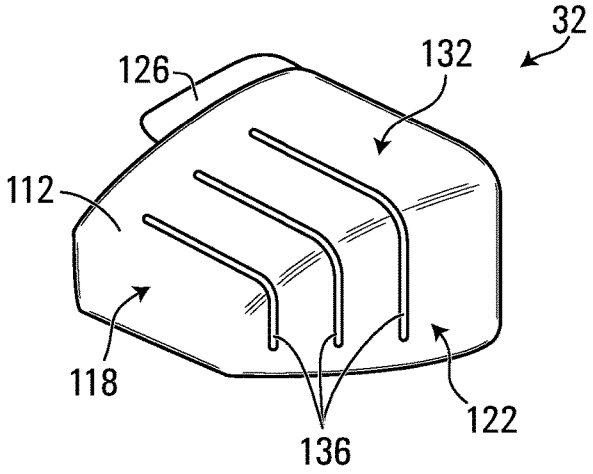
Figure 36:
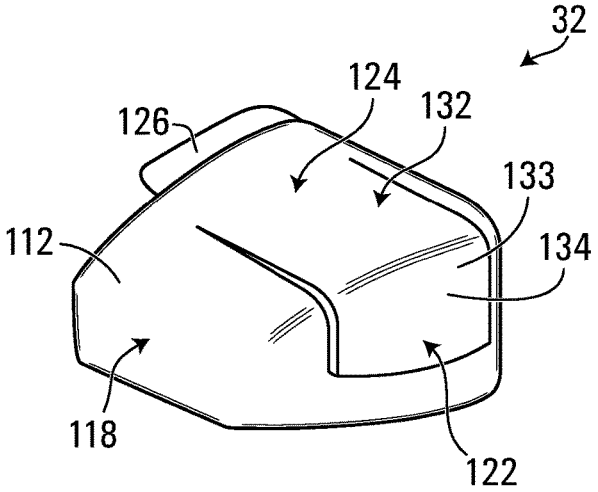

The reinforcement 132 may be implemented in any other suitable way in other embodiments. For example, in other embodiments, as shown in FIG. 35, each of the reinforcements $133_1$-$133_G$ may comprise a recess 136 on the outer surface 112 of the toe cap 32. For instance, the recess 136 may consist of a groove. As another example, in some embodiments, as shown in FIG. 36, the reinforcement 132 may have a single reinforcing element 133, such as a single projection 134.

In another variant, the toe cap 32 of the skate boot 22 may be configured such that a first part of the toe cap 32 that is more likely to be impacted by a puck during play may be more protective (e.g., stiffer, harder) than a second part of the toe cap 32 that is less likely to be impacted by a puck during play.

For instance, a given one of the lateral side portion 118, the medial side portion 120, the end portion 122 and the upper portion 124 of the toe cap 32 may be configured to be stiffer than another one of the lateral side portion 118, the medial side portion 120, the end portion 122 and the upper portion 124 of the toe cap 32. For example, a ratio of a stiffness of the lateral side portion 118 of the toe cap 32 over a stiffness of the medial side portion 120 of the toe cap 32 may be, in some cases, at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2 and in some cases even more.

To provide a part of the toe cap 32 with more stiffness than another part of the toe cap 32, the modulus of elasticity of certain parts of the toe cap 32 may vary. For instance, in some cases, the modulus of elasticity of a given one of the lateral side portion 118, the medial side portion 120, the end portion 122 and the upper portion 124 of the toe cap 32 may be greater than the modulus of elasticity of another one of the lateral side portion 118, the medial side portion 120, the end portion 122 and the upper portion 124 of the toe cap 32. For instance, in some examples of implementation, the modulus of elasticity of the lateral side portion 118 of the toe cap 32 may be greater than the modulus of elasticity of the medial side portion 120 of the toe cap 32. In some examples of implementation, the modulus of elasticity of the end portion 122 of the toe cap 32 may be greater than the modulus of elasticity of the medial side portion 120 of the toe cap 32. This may provide additional reinforcement at the lateral side portion 118 and/or the end portion 122 of the toe cap 32 where impact by a puck may be more likely to occur during play.

Figure 37:
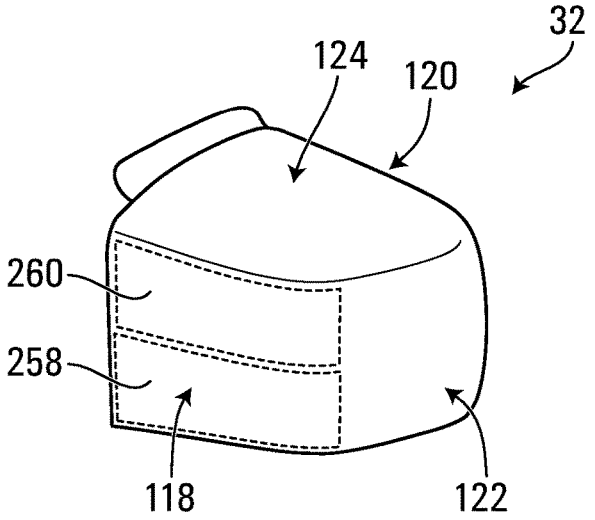
FIG. 37 shows a perspective view of the toe cap in accordance with a variant in which a first area of a lateral side portion of the toe cap is stiffer than a second area of the lateral side portion of the toe cap.

In some cases, the modulus of elasticity of a given one of the lateral side portion 118, the medial side portion 120, the end portion 122 and the upper portion 124 of the toe cap 32 may vary. For instance, in one example of implementation, as shown in FIG. 37, the modulus of elasticity of a first area 258 of the lateral side portion 118 of the toe cap 32 may be greater than the modulus of elasticity of a second area 260 of the lateral side portion 118 of the toe cap 32. For example, a ratio of the modulus of elasticity of the first area 258 of the lateral side portion 118 over the modulus of elasticity of the second area 260 of the lateral side portion 118 may be, in some cases, at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2 and in some cases even more. In this example, the first area 258 is lower than the second area 260 in the height-wise direction of the skate 10. For example, the first area 258 may be part of the bottom region 90 of the toe cap 32.

Figure 38:
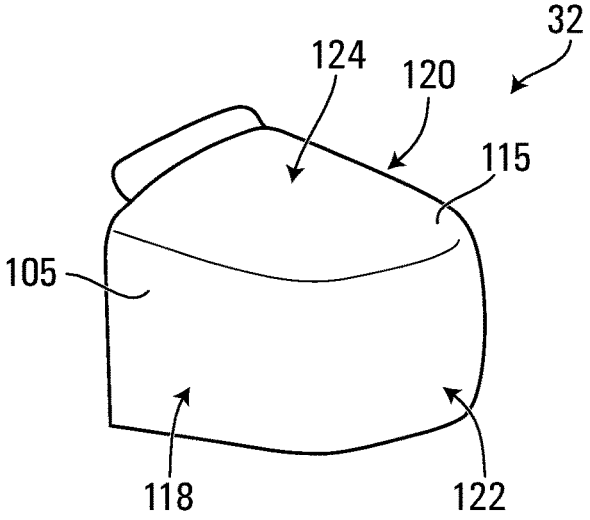
FIG. 38 shows a perspective view of the toe cap in accordance with a variant in which the toe cap comprises a first synthetic material and a second synthetic material.

To implement different stiffnesses at different parts of the toe cap 32, the toe cap 32 may comprise a plurality of materials having different properties. For example, with additional reference to FIG. 38, the toe cap 32 may comprise a second synthetic material 115 different from the first synthetic material 105 of the toe cap 32. The second synthetic material 115 of the toe cap 32 may be stiffer than the first synthetic material 105 of the toe cap 32. For example, a ratio of the modulus of elasticity of the second synthetic material 115 of the toe cap 32 over the modulus of elasticity of the first synthetic material 105 of the toe cap 32 may be, in some cases, at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2 and in some cases even more.

Figure 39:
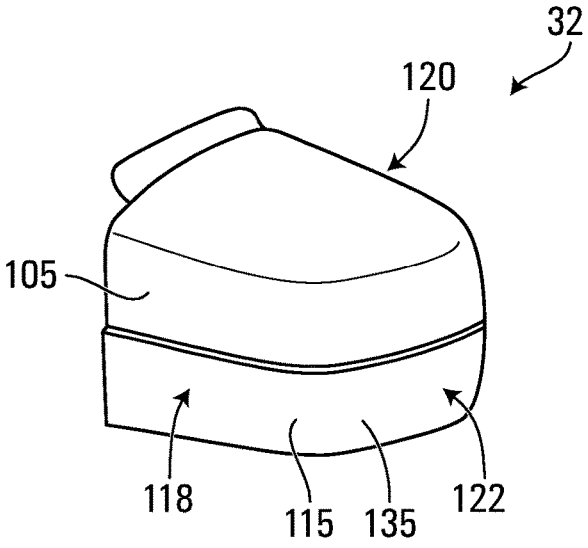
FIG. 39 shows a perspective view of the toe cap in accordance with a variant in which the toe cap comprises an overlay comprising the second synthetic material.

In one example of implementation, with additional reference to FIG. 39, an overlay 135 comprising the second synthetic material 115 of the toe cap 32 may be disposed over the first synthetic material 105 of the toe cap 32. For instance, the second synthetic material 115 of the toe cap 32 may be bonded to the first synthetic material 105 of the toe cap 32 in any suitable way. For example, the second synthetic material 115 of the toe cap 32 may be adhesively bonded, stitched, welded (e.g., ultrasonically welded) or overmolded onto the first synthetic material 105 of the toe cap 32.

In another example of implementation, in order to make a part of the toe cap 32 stiffer, the toe cap 32 may be configured such that its thickness $T_C$ varies. For example, a given one of the lateral side portion 118, the medial side portion 120, the end portion 122 and the upper portion 124 of the toe cap 32 may have a thickness that is greater than a thickness of another one of the lateral side portion 118, the medial side portion 120, the end portion 122 and the upper portion 124 of the toe cap 32. This may impart reinforcement at selected portion(s) of the toe cap 32 that are more likely to be impacted during play.

In one example of implementation, the bottom region 90 of the toe cap 32 may have a thickness that is greater than a remainder of the toe cap 90. As another example, a thickness of the lateral side portion 118 of the toe cap 32 may be greater than a thickness of the medial side portion 120 of the toe cap 32. In some cases, a thickness of the end portion 122 of the toe cap 32 may be greater than the thickness of the medial side portion 120 of the toe cap 32. The thickness of the toe cap 32 may vary in any other suitable way.

Furthermore, in some embodiments, the thickness of a given one of the lateral side portion 118, the medial side portion 120, the end portion 122 and the upper portion 124 of the toe cap 32 may vary. For instance, a thickness $T_{C1}$ of a first area 128 of the lateral side portion 118 may be greater than a thickness $T_{C2}$ of a second area 130 of the lateral side portion 118. A ratio of the thickness $T_{C1}$ of the first area 128 over the thickness $T_{C2}$ of the second area 130 may be at least 1.1, in some cases at least 1.2, in some cases at least 1.3, and in some cases even more. In this example, the first area 128 is lower than the second area 130 in the height-wise direction of the skate 10 such that a lower area of the lateral side portion 118 is thicker than an upper area of the lateral side portion 118.

In one example of implementation, the different thicknesses at different parts of the toe cap 32 may be provided through the second synthetic material 115 of the toe cap 32 when it is used as an overlay that is disposed over the first synthetic material 105 of the toe cap 32. For instance, the second synthetic material 115 of the toe cap 32 may have a thickness different from a thickness of the first synthetic material 105 of the toe cap 32. For example, the thickness of the second synthetic material 115 of the toe cap 32 may be less than the thickness of the first synthetic material 105 of the toe cap 32.

Figure 40:
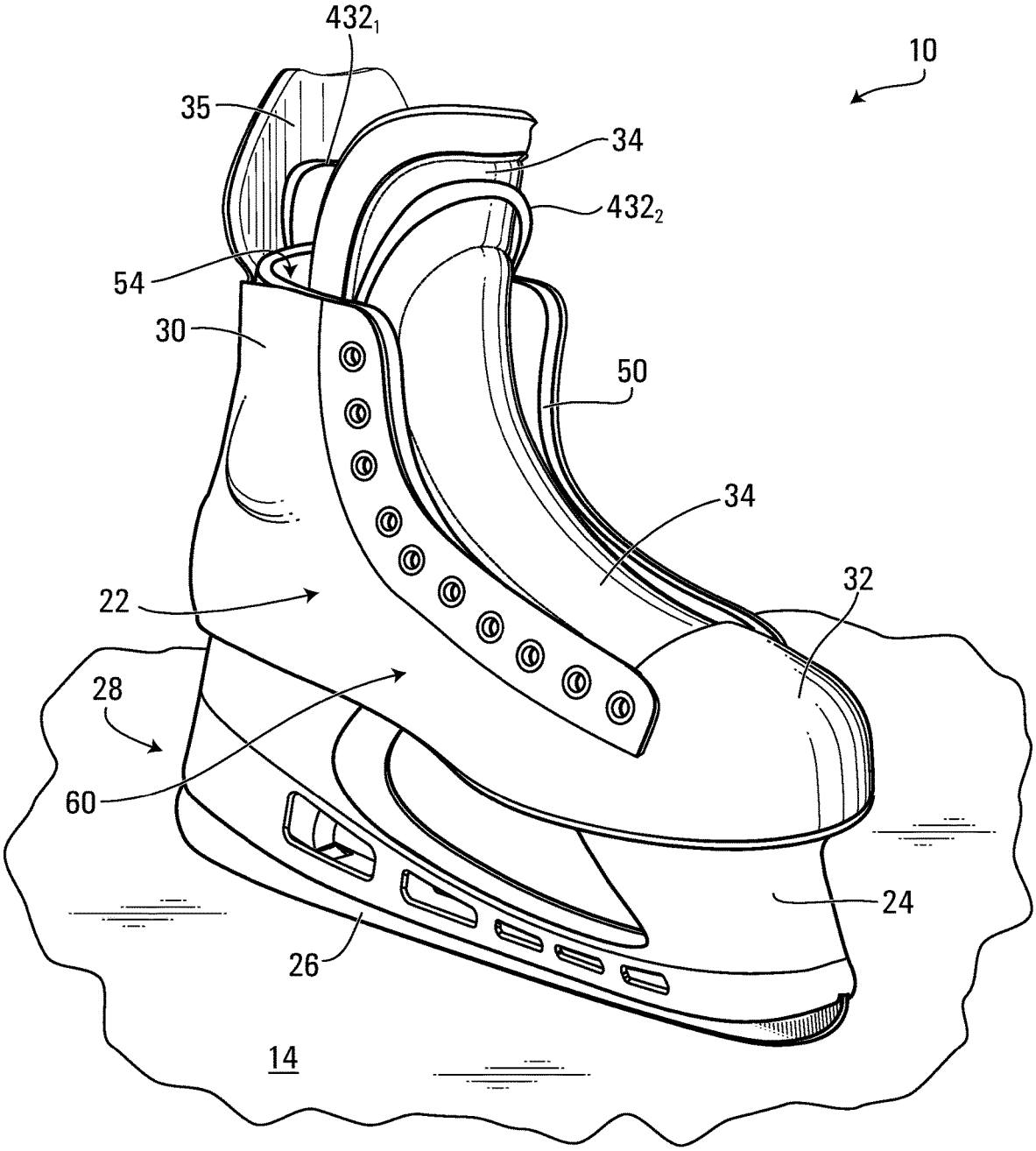
FIGS. 40 to 45 show variants of the footwear.

Although in embodiments considered above the skate 10 is designed specifically for goalkeeping by the goalie, as opposed to other skates for hockey players other than goalies (i.e., forwards and defensemen), in other embodiments, the skate 10 may be a player skate for the user who is a forward or defenseman, as shown in FIG. 40. In this embodiment, the shell 30 is a one-piece shell that is not articulated (i.e., does not comprise the upper and lower shell members $\mathbf{42}_1$, $\mathbf{42}_2$ that are movable relative to one another) and the skate 10 comprises a tendon guard 63 projecting upwardly from a rear part of the shell 30 to face the upper part UP of the Achilles tendon AT of the user.

Although in embodiments considered above the skate 10 is designed for playing ice hockey on the skating surface 14 which is ice, in other embodiments, the skate 10 may be constructed using principles described herein for playing roller hockey or another type of hockey (e.g., field or street hockey) on the skating surface 14 which is a dry skating surface (e.g., a polymeric, concrete, wooden, or turf skating surface or any other dry skating surface on which roller hockey or field or street hockey is played). Thus, in other embodiments, instead of comprising the blade 26, the skating element may comprise a set of wheels to roll on the dry skating surface 14.

Figure 41:
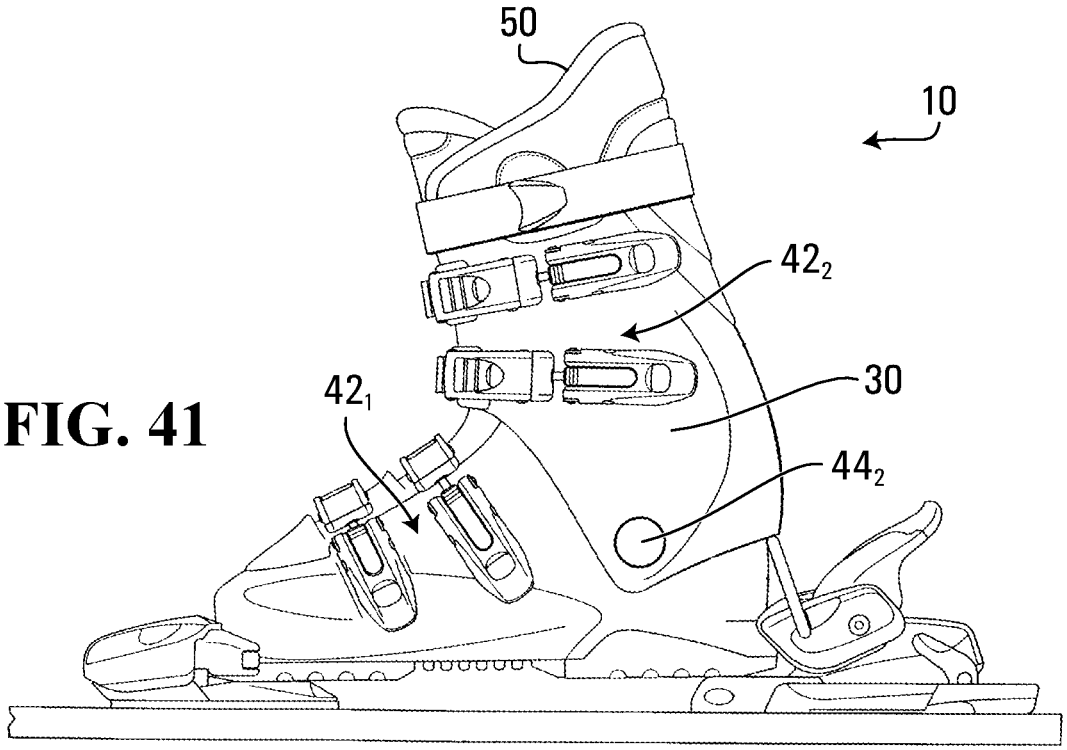
Figure 42:
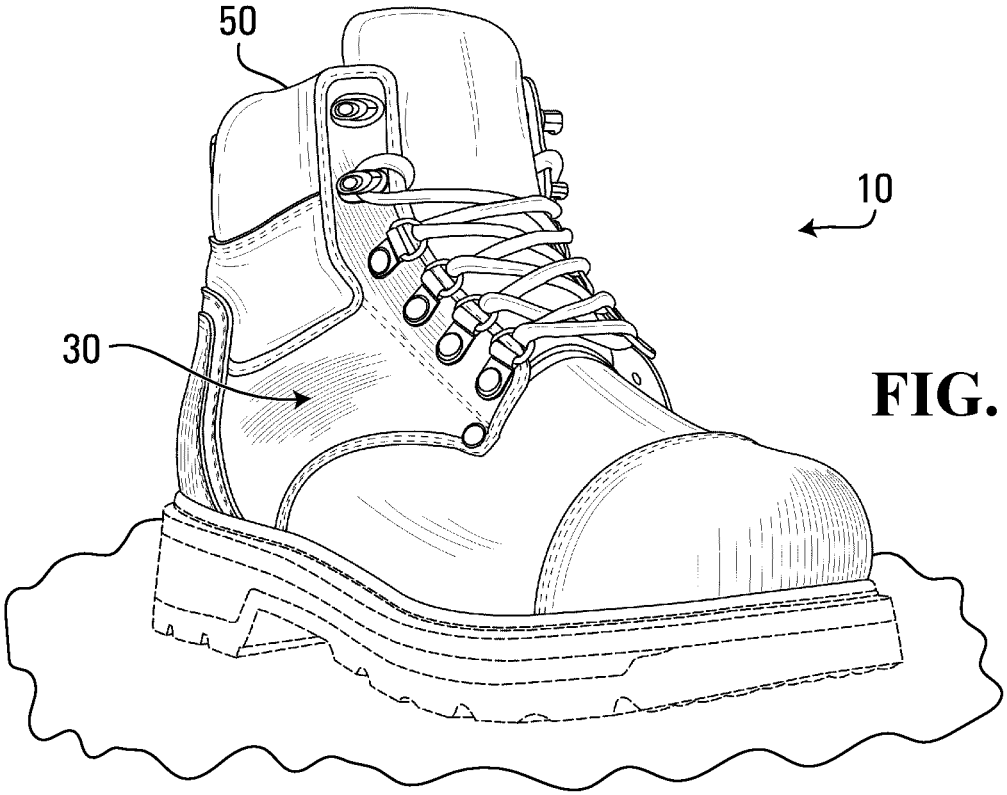
Figure 43:
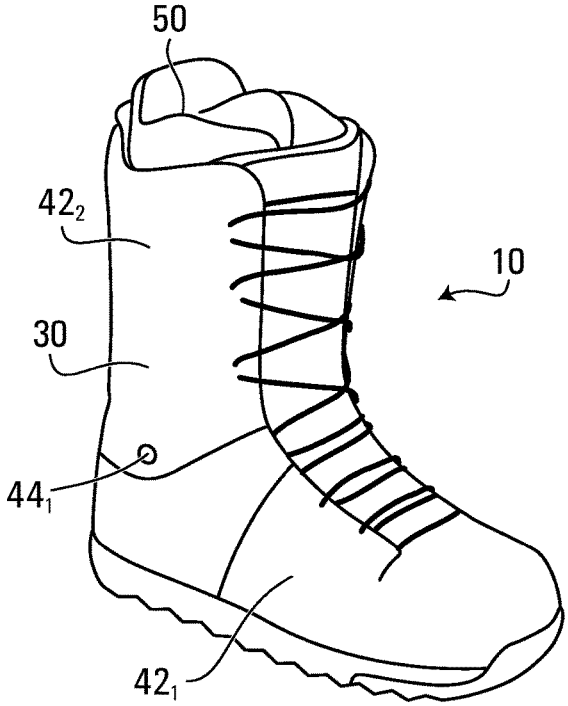
Figure 44:
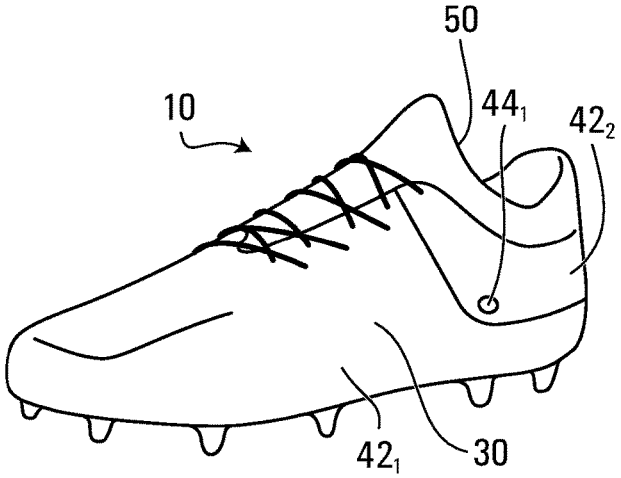
Figure 45:
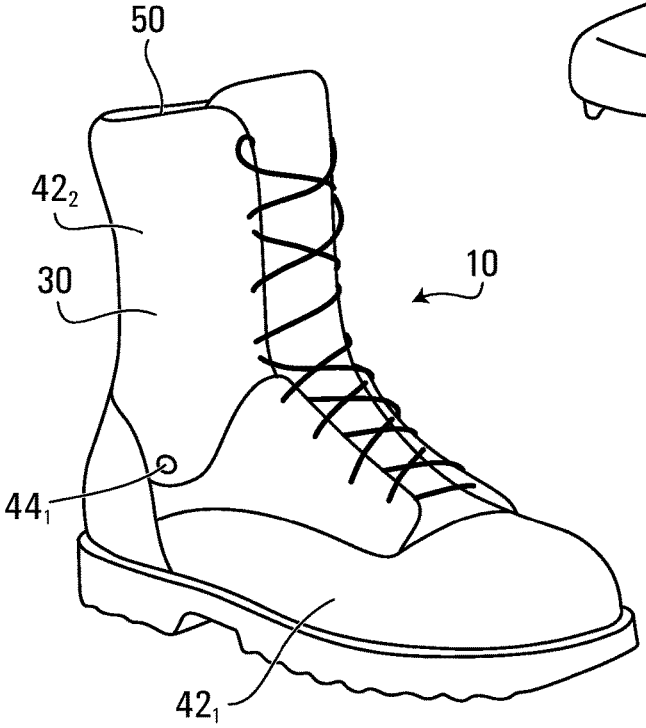

While in embodiments considered above the footwear 10 is a skate, in other embodiments, the footwear 10 may be any other suitable type of footwear. For example, as shown in FIG. 41, in some embodiments, the footwear 10 is an alpine, cross-country or touring ski boot designed for connecting to a ski to ski on snow and/or ice. As another example, as shown in FIG. 42, in some embodiments, the footwear 10 is a boot. As another example, as shown in FIG. 4, in some embodiments, the footwear 10 is snowboard boot designed for connecting to a snowboard binding to surf on snow and/or ice. As another example, as shown in FIG. 44, in some embodiments, the footwear 10 is a sports cleat. As another example, as shown in FIG. 45, in some embodiments, the footwear 10 is a working boot.

In some embodiments, any feature of any embodiment described herein may be combined with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

In case of any discrepancy, inconsistency, or other difference between terms used herein and terms used in any document incorporated by reference herein, meanings of the terms used herein are to prevail and be used.

Although various embodiments have been illustrated, this was for purposes of description, but should not be limiting. Various modifications will become apparent to those skilled in the art and are within the scope of this disclosure.

The invention claimed is:

1. A goalie skate for a hockey goalkeeper, the goalie skate comprising:

a. a skate boot for receiving a foot of the hockey goalkeeper, the skate boot comprising a shell and a liner;

b. a blade for contacting ice; and c. a blade holder between the skate boot and the blade;

the shell comprising a medial side portion configured to face a medial side of the hockey goalkeeper's foot, a lateral side portion configured to face a lateral side of the hockey goalkeeper's foot, a heel portion configured to face a heel of the hockey goalkeeper's foot, and an ankle portion configured to face an ankle of the hockey goalkeeper, the shell comprising an upper shell member including at least part of the ankle portion of the shell, the shell comprising a lower shell member distinct from the upper shell member and including at least part of the medial side portion of the shell, at least part of the lateral side portion of the shell, and at least part of the heel portion of the shell that are molded with one another as one piece, the shell being articulated such that the upper shell member of the shell is movable about a pivot relative to the lower shell member of the shell when the hockey goalkeeper is moving on the ice, the upper shell member of the shell and the pivot being configured to interface with the lower shell member of the shell to limit movement of the upper shell member of the shell relative to the lower shell member of the shell, the liner being removably disposed within the shell and comprising a thermoformable material such that the liner is configured to be thermoformable about the hockey goalkeeper's foot.

2. The goalie skate of claim 1, wherein at least a majority of the liner is configured to be thermoformable about the hockey goalkeeper's foot.

3. The goalie skate of claim 1, wherein at least part of the liner is non-thermoformable.

4. The goalie skate of claim 1, wherein the liner comprises a medial side portion configured to face the medial side of the hockey goalkeeper's foot, a lateral side portion configured to face the lateral side of the hockey goalkeeper's foot, a heel portion configured to face the heel of the hockey goalkeeper's foot, and an ankle portion configured to face the ankle of the hockey goalkeeper.

5. The goalie skate of claim 4, wherein at least part of the medial side portion of the liner and at least part of the lateral side portion of the liner are configured to be thermoformable about the hockey goalkeeper's foot.

6. The goalie skate of claim 4, wherein the liner comprises a toe portion configured to enclose toes of the hockey goalkeeper's foot.

7. The goalie skate of claim 6, wherein at least part of the toe portion of the liner is non-thermoformable.

8. The goalie skate of claim 4, wherein the liner comprises an instep portion configured to face an instep of the hockey goalkeeper's foot.

9. The goalie skate of claim 8, wherein the liner comprises a tongue including the instep portion of the liner.

10. The goalie skate of claim 4, wherein the liner comprises a sole portion configured to face a plantar surface of the hockey goalkeeper's foot.

11. The goalie skate of claim 10, wherein at least part of the sole portion of the liner is configured to be thermoformable about the hockey goalkeeper's foot.

12. The goalie skate of claim 1, wherein the liner comprises a thermoformable portion and a non-thermoformable portion.

13. The goalie skate of claim 1, wherein the liner comprises the thermoformable material and a non-thermoformable material.

14. The goalie skate of claim 1, wherein the thermoformable material of the liner is a first thermoformable material, and the liner comprises a plurality of thermoformable materials that are different and that include the first thermoformable material.

15. The goalie skate of claim 14, wherein the thermoformable materials of the liner include foams.

16. The goalie skate of claim 14, wherein the thermoformable materials of the liner are fastened to one another.

17. The goalie skate of claim 1, wherein the liner comprises a lace and lacing openings receiving the lace.

18. The goalie skate of claim 1, wherein the shell comprises a thermoformable material such that the shell is configured to be thermoformable about the hockey goalkeeper's foot.

19. The goalie skate of claim 18, wherein a thermoformable portion of the shell overlies a thermoformable portion of the liner.

20. The goalie skate of claim 19, wherein: the thermoformable portion of the shell is a first thermoformable portion of the shell; a second thermoformable portion of the shell overlies a second thermoformable portion of the liner; a thermoformability of the first thermoformable portion of the shell is greater than a thermoformability of the second thermoformable portion of the shell; and a thermoformability of the first thermoformable portion of the liner is greater than a thermoformability of the second thermoformable portion of the liner.

21. The goalie skate of claim 1, wherein at least part of the upper shell member and at least part of the lower shell member are thermoformable about the hockey goalkeeper's foot.

22. The goalie skate of claim 1, wherein at least a majority of the upper shell member and at least part a majority of the lower shell member are configured to be thermoformable about the hockey goalkeeper's foot.

23. The goalie skate of claim 1, wherein the shell comprises a plurality of zones that differ in stiffness.

24. The goalie skate of claim 23, wherein a thickness of the shell varies between the plurality of zones of the shell.

25. The goalie skate of claim 23, wherein the plurality of zones of the shell comprise a plurality of materials that are different.

26. The goalie skate of claim 1, wherein the shell comprises a reinforcing rib.

27. The goalie skate of claim 1, wherein the shell comprises a plurality of reinforcing ribs.

28. The goalie skate of claim 1, wherein the upper shell member is pivotable relative to the lower shell member by at least 20°.

29. The goalie skate of claim 1, wherein the pivot comprises: a medial pivot element pivotally connecting a medial part of the lower shell member and a medial part of the upper shell member; and a lateral pivot element pivotally connecting a lateral part of the lower shell member and a lateral part of the upper shell member.

30. The goalie skate of claim 1, wherein the shell comprises a fiber-reinforced composite.

31. The goalie skate of claim 1, wherein each of the upper shell member and the lower shell member is molded.

32. The goalie skate of claim 1, wherein the upper shell member is disposed over the lower shell member.

33. The goalie skate of claim 1, wherein the lower shell member and the upper shell member constitute at least part of an exterior of the goalie skate.

34. The goalie skate of claim 1, wherein the shell is configured to cover at least 80% of a total surface of the hockey goalkeeper's foot when the hockey goalkeeper wears the goalie skate.

35. The goalie skate of claim 1, wherein the medial side portion of the shell is configured to completely cover the medial side of the hockey goalkeeper's foot, the lateral side portion of the shell is configured to completely cover the lateral side of the hockey goalkeeper's foot, and the heel portion of the shell is configured to completely cover the heel of the hockey goalkeeper's foot.

36. The goalie skate of claim 1, wherein rearward movement of the upper shell member of the shell relative to the lower shell member of the shell is limited by the upper shell member of the shell engaging a portion of the lower shell member of the shell.

37. The goalie skate of claim 36, wherein the portion of the lower shell member of the shell comprises a projection of the lower shell member of the shell that projects from an adjacent part of the lower shell member of the shell.

38. The goalie skate of claim 37, wherein, when the upper shell member of the shell and the lower shell member of the shell are in a neutral position, the upper shell member of the shell abuts the projection of the lower shell member of the shell.

39. The goalie skate of claim 1, wherein the skate boot comprises a strap configured to engage at least a portion of the liner and at least a portion of the upper shell member of the shell and wherein a portion of the liner extending above the shell is free from engaging the strap.

40. A goalie skate for a hockey goalkeeper, the goalie skate comprising:

a. a skate boot for receiving a foot of the hockey goalkeeper, the skate boot comprising a shell and a liner;

b. a blade for contacting ice; and c. a blade holder between the skate boot and the blade;

the shell comprising a medial side portion configured to face a medial side of the hockey goalkeeper's foot, a lateral side portion configured to face a lateral side of the hockey goalkeeper's foot, a heel portion configured to face a heel of the hockey goalkeeper's foot, an ankle portion configured to face an ankle of the hockey goalkeeper, and a toe portion configured to face toes of the hockey goalkeeper, the shell comprising:

a lower shell member including at least part of the medial side portion of the shell, at least part of the lateral side portion of the shell, at least part of the heel portion of the shell, and at least part of the toe portion of the shell that are molded with one another as one piece; and an upper shell member distinct from the lower shell member and including at least part of the ankle portion of the shell and pivotable about a pivot relative to the lower shell member when the hockey goalkeeper is moving on the ice, the upper shell member of the shell and the pivot being configured to interface with the lower shell member of the shell to limit the pivoting of the upper shell member of the shell relative to the lower shell member of the shell, the liner being removably disposed within the shell and comprising a thermoformable material configured to be thermoformable about the hockey goalkeeper's foot.

41. A goalie skate for a hockey goalkeeper, the goalie skate comprising:

a. a skate boot for receiving a foot of the hockey goalkeeper, the skate boot comprising a shell and a liner;

b. a blade for contacting ice; and c. a blade holder between the skate boot and the blade;

wherein: the shell comprises a medial side portion configured to face a medial side of the hockey goalkeeper's foot, a lateral side portion configured to face a lateral side of the hockey goalkeeper's foot, a heel portion configured to face a heel of the hockey goalkeeper's foot, and an ankle portion configured to face an ankle of the hockey goalkeeper, the shell comprising an upper shell member including at least part of the ankle portion of the shell, the shell comprising a lower shell member distinct from the upper shell member and including at least part of the medial side portion of the shell, at least part of the lateral side portion of the shell, and at least part of the heel portion of the shell that are molded with one another as one piece, the shell being articulated such that the upper shell member of the shell is movable about a pivot relative to the lower shell member of the shell when the hockey goalkeeper is moving on the ice, the upper shell member of the shell and the pivot being configured to interface with the lower shell member of the shell to limit movement of the upper shell member of the shell relative to the lower shell member of the shell, the shell being configured to be thermoformable about the hockey goalkeeper's foot, the liner being disposed within the shell.

42. The goalie skate of claim 41, wherein the liner is removably disposed within the shell.

43. A goalie skate for a hockey goalkeeper, the goalie skate comprising:

a. a skate boot for receiving a foot of the hockey goalkeeper, the skate boot comprising a shell and a liner;

b. a blade for contacting ice; and c. a blade holder between the skate boot and the blade;

wherein: the shell comprises a medial side portion configured to face a medial side of the hockey goalkeeper's foot, a lateral side portion configured to face a lateral side of the hockey goalkeeper's foot, a heel portion configured to face a heel of the hockey goalkeeper's foot, and an ankle portion configured to face an ankle of the hockey goalkeeper;

the shell comprises a plurality of distinct pieces that are movable relative to one another;

a lower one of the distinct pieces of the shell includes at least part of the medial side portion of the shell, at least part of the lateral side portion of the shell, and at least part of the heel portion of the shell that are molded with one another;

the shell is configured to be thermoformable about the hockey goalkeeper's foot; and the liner is removably disposed within the shell and comprises a thermoformable material configured to be thermoformable about the hockey goalkeeper's foot.

* * * * *